US007831165B2

(12) United States Patent
Segawa

(10) Patent No.: US 7,831,165 B2
(45) Date of Patent: Nov. 9, 2010

(54) FIXING DEVICE AND IMAGE FORMING APPARATUS EQUIPPED WITH THE FIXING DEVICE

(75) Inventor: Yuichi Segawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 84 days.

(21) Appl. No.: 12/412,965

(22) Filed: Mar. 27, 2009

(65) Prior Publication Data

US 2009/0252520 A1 Oct. 8, 2009

(30) Foreign Application Priority Data

Mar. 27, 2008 (JP) ..... 2008-082275
Mar. 27, 2008 (JP) ..... 2008-082276
Mar. 27, 2008 (JP) ..... 2008-082277
Mar. 27, 2008 (JP) ..... 2008-082278

(51) Int. Cl.
*G03G 15/20* (2006.01)

(52) U.S. Cl. ..... 399/69; 399/122; 399/329

(58) Field of Classification Search ..... 399/38, 399/67–70, 107, 110, 122, 320, 328, 329
See application file for complete search history.

(56) References Cited

U.S. PATENT DOCUMENTS 6,088,558 A * 7/2000 Yamada et al. ..... 399/165
7,660,553 B2 * 2/2010 Kikuchi ..... 399/329
2007/0048043 A1 * 3/2007 Chang ..... 399/329
2007/0059059 A1 * 3/2007 Fujino ..... 399/329
2008/0240807 A1 * 10/2008 Lee et al. ..... 399/329

FOREIGN PATENT DOCUMENTS

| | | |
|---|---|---|
| JP | 05-281816 | 10/1993 |
| JP | 05-281878 | 10/1993 |
| JP | 11-133771 | 5/1999 |
| JP | 2002-148983 | 5/2002 |
| JP | 2005-257824 | 9/2005 |
| JP | 2005-266199 | 9/2005 |
| JP | 2006-251481 | 9/2006 |
| JP | 2007-183365 | 7/2007 |

* cited by examiner

*Primary Examiner*—Hoan Tran
(74) *Attorney, Agent, or Firm*—Workman Nydegger

(57) ABSTRACT

Provided is a fixing device including: a first mode which is a combination mode of the heating of the heating belt and the rotation stop of the heating belt and a second mode which is a combination mode of the heating of the heating belt and the rotation of the heating belt are set; at the time of returning of the heating belt for an image forming operation from non-heating and non-rotation of the heating belt, the heating belt is controlled by the first mode and the heating belt is then controlled by the second mode transitioned from the first mode; and when a temperature of the heating belt becomes equal to or larger than a mode transition reference temperature which is set on the basis of a predetermined condition, the transition from the first mode to the second mode is performed.

34 Claims, 14 Drawing Sheets

FIXING DEVICE AND IMAGE FORMING APPARATUS EQUIPPED WITH THE FIXING DEVICE

BACKGROUND

1. Technical Field

The present invention relates to a fixing device which is used in formation of an electrophotographic image and performs fixing by a heating belt, and an image forming apparatus including the same.

2. Related Art

A belt-fixing type fixing device is known as a fixing device of an image forming apparatus. This belt-fixing type fixing device includes an endless heating belt and a pressurization roller. The heating belt is stretched over a fixing roller and a heating roller with tension. A toner image of a transfer material is heated and pressurized at a nip portion (pressing portion) of the heating belt and the pressurization roller so as to be fixed on the transfer material.

However, in the belt-fixing type fixing device, a fixing belt stretched over a pair of rollers may be skewed and thus the fixing belt may be damaged. In order to prevent this, a fixing device which suppresses the bias of the fixing belt by guide rings provided at both ends of the heating roller so as to prevent the skew of the fixing belt is suggested in Japanese Patent No. 3711717, for example. In the fixing device, a vertical surface and an inclined surface are provided in the wall surfaces of the guide rings facing the fixing belt. By the vertical surfaces of the guide rings, the bias of the fixing belt is suppressed. In addition, when the fixing belt rides over the inclined surface by the skew, the fixing belt is prevented from riding over the inclined surface.

Generally, the heating roller is formed of, for example, a metal material such as aluminum, in view of strength and heat transfer to the heating belt. In addition, the heating belt is formed of a thin flexible belt obtained by coating a belt base material such as nickel with silicon rubber or the like. Accordingly, a thermal expansion coefficient of the heating roller is relatively large and a thermal expansion coefficient of the heating belt is relatively small. In addition, when a power source of the heating roller is turned off, the belt has a low temperature. However, when the power source of the image forming apparatus is switched from an OFF state to an ON state or an image forming command is generated from a sleep mode (power saving mode), a belt heating operation and a belt rotation operation are substantially simultaneously started.

However, when the image forming apparatus is set to the above-described mode after the heating belt is heated by an image forming operation, the heating belt and the heating roller are cooled. At this time, a heat contraction amount of the heating roller in an axial direction becomes larger than that of the heating belt in a width direction. Then, as shown in FIG. 14, a guide ring b of a heating roller a strongly presses a belt edge d of a heating belt c with force Ft. In this case, a central portion of a width direction of the heating belt c cannot easily slide in the width direction due to friction with the heating roller (not shown). Accordingly, large stress is applied to an end (an area of the belt close to the belt edge in the width direction) of the heating belt c and several wrinkles e (waving of irregularities) are generated in the heating belt c in the width direction of the belt.

If an image forming command is generated in a state in which the wrinkles e are generated, the belt heating operation and the belt rotation operation are substantially simultaneously started as described above. Then, since the edge d of the belt portion entering the heating roller a is continuously pressed by the guide ring b in the width direction and the wrinkles e are moved, adjacent concave portions overlap with each other and crack occurs in the heating belt c.

SUMMARY

An advantage of some aspects of the invention is that it provides a fixing device and an image forming apparatus capable of suppressing crack from occurring in a heating belt at the time of returning for an image forming operation from a belt temperature state lower than a belt control temperature during the image forming operation.

According to a fixing device of the invention, at the time of the returning of a heating belt for an image forming operation from a low belt temperature state of the heating belt due to the OFF state of a power source of a heating roller in a power source off state or a sleep mode (power saving mode), two modes are set with respect to the heating control and the rotation control of the heating belt. The first mode is a combination mode of the heating of the heating belt and the rotation stop of the heating belt. The second mode is a combination mode of the heating of the heating belt and the rotation of the heating belt.

Accordingly, at the time of the returning of the heating belt, the heating belt is first heated by the setting of the first mode, but the heating belt is not rotated. Next, when the surface temperature of the heating belt is increased to a mode transition reference temperature, the heating of the heating belt is continuously performed and the heating belt is rotated, by the setting of the second mode. At this time, wrinkles of the heating belt disappear. Accordingly, the bias of the heating belt entering the heating roller can be suppressed by a bias preventing unit. In addition, although the bias preventing unit presses an edge of a belt portion of the heating belt in a width direction, since the wrinkles are not present in the heating belt, it is possible to prevent the generation of crack in the heating belt. Accordingly, it is possible to adequately perform the heating, the pressurization and fixing using the fixing device over a long period of time.

In particular, since the temperature of the heating belt at a position thereof where the temperature becomes the lowest is used as the temperature of the heating belt, it is possible to prevent the generation of crack in the heating belt in a more effective manner.

Moreover, since the mode transition reference heating time of the heating belt is used in the transition from the first mode to the second mode, the calorific capacity of the heating belt and the heating roller and the heater wattage of the heating roller are taken into consideration. Accordingly, the control of the heating belt can be performed in a more accurate manner.

According to an image forming apparatus including the fixing device of the invention, since the heating, the pressurization, and the fixing can be adequately performed, it is possible to form an image with high quality over a long period of time.

According to a fixing device of the invention, at the time of the returning of a heating belt for an image forming operation from a low belt temperature state of the heating belt due to the OFF state of a power source of a heating roller in a power source off state or a sleep mode (power saving mode), two modes are set with respect to the heating control and the rotation control of the heating belt. The first mode is a combination mode of the heating of the heating belt and the rotation stop of the heating belt. The second mode is a combination mode of the heating of the heating belt and the rotation of the heating belt. In this case, the mode transition reference temperature and the mode transition reference heating time are set on the basis of the temperature of the heating belt at the time of the start of the control of the heating belt by the first mode.

Accordingly, at the time of the returning of the heating belt, the heating belt is first heated by the setting of the first mode, but the heating belt is not rotated. Next, when the surface temperature of the heating belt is increased to a mode transition reference temperature, the heating of the heating belt is continuously performed and the heating belt is rotated, by the setting of the second mode. At this time, wrinkles of the heating belt disappear.

In such a case, at the time of the start of the control of the heating belt by the first mode, if the temperature of the heating belt is high (e.g., when the image forming apparatus 1 is used under high-temperature environment of 35° C. or higher; when the sleep mode is released during decrease in the temperature of the heating belt in which the image forming operation ends and it transitions to the sleep mode; or the like), there is a possibility that the second mode is started before the wrinkles occurred in the heating belt disappear. However, in the invention, since the mode transition reference temperature is set on the basis of the temperature of the heating belt at the time of the start of the control of the heating belt by the first mode, the heating belt can be adequately heated. Accordingly, even when the temperature of the heating belt is high at the time of the start of the control of the heating belt by the first mode, the heating and the rotation of the heating belt by the second mode can be performed after the wrinkles of the heating belt are certainly disappeared.

On the other hand, at the time of the start of the control of the heating belt by the first mode, if the temperature of the heating belt is low (e.g., when the image forming apparatus 1 is used under low-temperature environment of 10° C. or lower, or the like), a temperature difference occurs in the heating belt at the time of the start of the second mode. That is, a large temperature difference occurs between a high-temperature portion of the heating belt which is wound on the heating roller and a low-temperature portion of the heating belt which is not wound on the heating roller. Due to the large temperature difference, adverse effects such as the thermal destruction of the heating belt, the damage of the end of the high-temperature portion of the heating belt, or a concave deformation of a central portion in the width direction of the heating belt, are caused. However, since the mode transition reference temperature is set on the basis of the temperature of the heating belt at the time of the start of the control of the heating belt by the first mode, the heating roller can be adequately heated. Accordingly, even when the temperature of the heating belt at the time of the start of the control of the heating belt by the first mode is low, the heating and the rotation of the heating belt by the second mode can be performed without causing such adverse effects.

Accordingly, the bias of the heating belt entering the heating roller can be suppressed by a bias preventing unit. In addition, regardless of use environment, although the bias preventing unit presses an edge of a belt portion of the heating belt in a width direction, since the wrinkles are not present in the heating belt, it is possible to prevent the generation of crack in the heating belt. Accordingly, it is possible to adequately perform the heating, the pressurization and fixing using the fixing device over a long period of time.

In particular, since the temperature of the heating belt at a position thereof where the temperature becomes the lowest is used as the temperature of the heating belt, it is possible to prevent the generation of crack in the heating belt in a more effective manner.

Moreover, since the mode transition reference heating time of the heating belt is used in the transition from the first mode to the second mode, the calorific capacity of the heating belt and the heating roller and the heater wattage of the heating roller are taken into consideration. Accordingly, the control of the heating belt can be performed in a more accurate manner.

According to an image forming apparatus including the fixing device of the invention, since the heating, the pressurization, and the fixing can be adequately performed, it is possible to form an image with high quality over a long period of time.

According to a fixing device of the invention, at the time of the returning of a heating belt for an image forming operation from a low belt temperature state of the heating belt due to the OFF state of a power source of a heating roller in a power source off state or a sleep mode (power saving mode), two modes are set with respect to the heating control and the rotation control of the heating belt. The first mode is a combination mode of the heating of the heating belt and the rotation stop of the heating belt. The second mode is a combination mode of the heating of the heating belt and the rotation of the heating belt. In this case, the mode transition reference temperature and the mode transition reference heating time are set on the basis of the temperature of the heating belt at the time of the rotation stop of the heating belt at the end of a previous image forming operation.

Accordingly, at the time of the returning of the heating belt, the heating belt is first heated by the setting of the first mode, but the heating belt is not rotated. Next, when the surface temperature of the heating belt is increased to a mode transition reference temperature, the heating of the heating belt is continuously performed and the heating belt is rotated, by the setting of the second mode. At this time, wrinkles of the heating belt disappear.

In such a case, the temperature of the heating belt may change due to difference in the contents of the previous image forming operations. For example, in an image forming apparatus in which a central position thereof in a direction perpendicular to a movement direction of the transfer material is set to a central position in the width direction of the heating belt, the temperature at both ends of the heating belt and the heating roller after continuous printing (continuous image formation) is performed on a transfer material of a small size smaller than a normal size becomes about 30° C. higher than that after the continuous printing of the same number of pages is performed on a transfer material of the normal size. This is because an area of the heating belt through which the transfer material passes is deprived of heat by the transfer material but an area of the heating belt through which the transfer material does not pass is not deprived of heat by the transfer material.

Moreover, after the continuously printing of a number of pages is performed on the transfer material of the normal size, the temperature of the heating roller and the heating belt increases temporarily due to an overshoot. As such, if the temperature of the heating belt and the heating roller during the rotation stop of the heating belt is high, the temperature change becomes large when the temperature of the heating belt and the heating roller decreases to a normal temperature (e.g., a room temperature or the like) at the end of the image forming operation. Therefore, the amount of wrinkles occurred in the heating belt increases. Further, if the temperature of the heating roller at the end of the image forming operation is high, a difference from the mode transition reference temperature becomes relatively small. Therefore, there is a fear that the heating period in the first mode becomes short and that the second mode is set in a state in which the wrinkles of the heating belt are not yet disappeared.

However, in the image forming apparatus according to the invention, since the mode transition reference temperature is set on the basis of the temperature of the heating belt during the rotation stop of the heating belt at the end of the previous image forming operation, it is possible to increase the amount of heating of the heating belt in a subsequent power source off state. Therefore, the heating belt can be adequately heated. Accordingly, even when the temperature of the heating belt is high at the time of the start of the control of the heating belt by the first mode, the heating and the rotation of the heating belt by the second mode can be performed after the wrinkles of the heating belt are certainly disappeared.

Accordingly, the bias of the heating belt entering the heating roller can be suppressed by a bias preventing unit. In addition, although the bias preventing unit presses an edge of a belt portion of the heating belt in a width direction, since the wrinkles are not present in the heating belt, it is possible to certainly prevent the generation of crack in the heating belt. Accordingly, it is possible to adequately perform the heating, the pressurization and fixing using the fixing device over a long period of time.

In particular, since the temperature of the heating belt at a position thereof where the temperature becomes the highest in the width direction thereof is used as the temperature of the heating belt, it is possible to effectively increase the amount of heating of the heating belt. Therefore, it is possible to prevent the generation of crack in the heating belt in a more effective manner.

Moreover, since the mode transition reference heating time is used in the transition from the first mode to the second mode, the calorific capacity of the heating belt and the heating roller and the heater wattage of the heating roller are taken into consideration. Further, the mode transition reference heating time is set on the basis of the temperature of the heating belt during the rotation stop of the heating belt at the end of the previous image forming operation. Accordingly, the control of the heating belt can be performed in a more accurate manner.

According to an image forming apparatus including the fixing device of the invention, since the heating, the pressurization, and the fixing can be adequately performed, it is possible to form an image with high quality over a long period of time.

According to a fixing device of the invention, at the time of the returning of a heating belt for an image forming operation from a low belt temperature state of the heating belt due to the OFF state of a power source of a heating roller in a power source off state or a sleep mode (power saving mode), two modes are set with respect to the heating control and the rotation control of the heating belt. The first mode is a combination mode of the heating of the heating belt and the rotation stop of the heating belt. The second mode is a combination mode of the heating of the heating belt and the rotation of the heating belt. In this case, the mode transition reference temperature and the mode transition reference heating time are set on the basis of the temperature of the heating belt during the rotation stop of the heating belt at the end of the previous image forming operation.

Accordingly, at the time of the returning of the heating belt, the heating belt is first heated by the setting of the first mode, but the heating belt is not rotated. Next, when the surface temperature of the heating belt is increased to a mode transition reference temperature, the heating of the heating belt is continuously performed and the heating belt is rotated, by the setting of the second mode. At this time, wrinkles of the heating belt disappear.

In such a case, the temperature of the heating belt may change due to difference in the contents of the previous image forming operations. For example, in an image forming apparatus in which a central position thereof in a direction perpendicular to a movement direction of the transfer material is set to a central position in the width direction of the heating belt, the temperature at both ends of the heating belt and the heating roller after continuous printing (continuous image formation) is performed on a transfer material of a small size smaller than a normal size becomes about 30° C. higher than that after the continuous printing of the same number of pages is performed on a transfer material of the normal size. This is because an area of the heating belt through which the transfer material passes is deprived of heat by the transfer material but an area of the heating belt through which the transfer material does not pass is not deprived of heat by the transfer material.

Moreover, after the continuously printing of a number of pages is performed on the transfer material of the normal size, the temperature of the heating roller and the heating belt increases temporarily due to an overshoot. As such, if the temperature of the heating belt and the heating roller during the rotation stop of the heating belt is high, the temperature change becomes large when the temperature of the heating belt and the heating roller decreases to a normal temperature (e.g., a room temperature or the like) at the end of the image forming operation. Therefore, the amount of wrinkles occurred in the heating belt increases. Further, if the temperature of the heating roller at the end of the image forming operation is high and if the image forming apparatus returns to the image forming operation during a time when the temperature of the heating roller is not decreases much, a difference from the mode transition reference temperature becomes relatively small. Therefore, there is a fear that the heating period in the first mode becomes short and that the second mode is set in a state in which the wrinkles of the heating belt are not yet disappeared.

However, in the image forming apparatus according to the invention, since the mode transition reference temperature is set on the basis of at least one of the size of the transfer material during a previous image forming operation and the number of image forming pages, it is possible to control the amount of heating of the heating belt in a subsequent power source off state in accordance with the amount of wrinkles occurred in the heating belt.

In this case, when the size of the transfer material during the previous image forming operation in the same direction as the width direction of the heating belt is smaller than the normal size (e.g., the size of A4 at the time of longitudinal transport thereof) with respect to the width of the heating belt, the mode transition reference temperature is set to be higher. On the other hand, when the size of the transfer material during the previous image forming operation in the same direction as the width direction of the heating belt is equal to or larger than the normal size with respect to the width of the heating belt, the mode transition reference temperature is set to be lower than that when it is smaller than the normal size.

Moreover, when the number of continuous image forming pages during the previous image forming operation is larger than a normal number of pages (e.g., 5 pages or more), the mode transition reference temperature is set to be higher. On the other hand, when the number of continuous image forming pages during the previous image forming operation is smaller than the normal number of pages, the mode transition reference temperature is set to be lower than that when it is larger than the normal number of pages.

Therefore, in the first mode, the heating belt can be appropriately heated in accordance with the fixing states (that is, the size of the transfer material during the previous image forming operation and the number of continuous image forming pages) during the previous image forming operation on the basis of the mode transition reference temperature. Accordingly, the heating and the rotation of the heating belt by the second mode can be performed after the wrinkles of the heating belt are certainly disappeared in the first mode.

Accordingly, the bias of the heating belt entering the heating roller can be suppressed by a bias preventing unit. In addition, although the bias preventing unit presses an edge of a belt portion of the heating belt in a width direction, since the wrinkles are not present in the heating belt, it is possible to prevent the generation of crack in the heating belt. Accordingly, it is possible to adequately perform the heating, the pressurization and fixing using the fixing device over a long period of time.

In particular, since the temperature of the heating belt at a position thereof where the temperature becomes the highest in the width direction thereof is used as the temperature of the heating belt, it is possible to effectively increase the amount of heating of the heating belt. Therefore, it is possible to prevent the generation of crack in the heating belt in a more effective manner.

Moreover, since the mode transition reference heating time is used in the transition from the first mode to the second mode, the calorific capacity of the heating belt and the heating roller and the heater wattage of the heating roller are taken into consideration. Further, the mode transition reference heating time is set on the basis of at least one of the size of the transfer material during the previous image forming operation and the number of continuous image forming pages. Therefore, in the first mode, the heating belt can be appropriately heated in accordance with the fixing states (that is, the size of the transfer material during the previous image forming operation and the number of continuous image forming pages) during the previous image forming operation on the basis of mode transition reference heating time. Accordingly, the heating and the rotation of the heating belt by the second mode can be performed after the wrinkles of the heating belt are certainly disappeared in the first mode. Accordingly, the control of the heating belt can be performed in a more accurate manner.

According to an image forming apparatus including the fixing device of the invention, since the heating, the pressurization, and the fixing can be adequately performed, it is possible to form an image with high quality over a long period of time.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
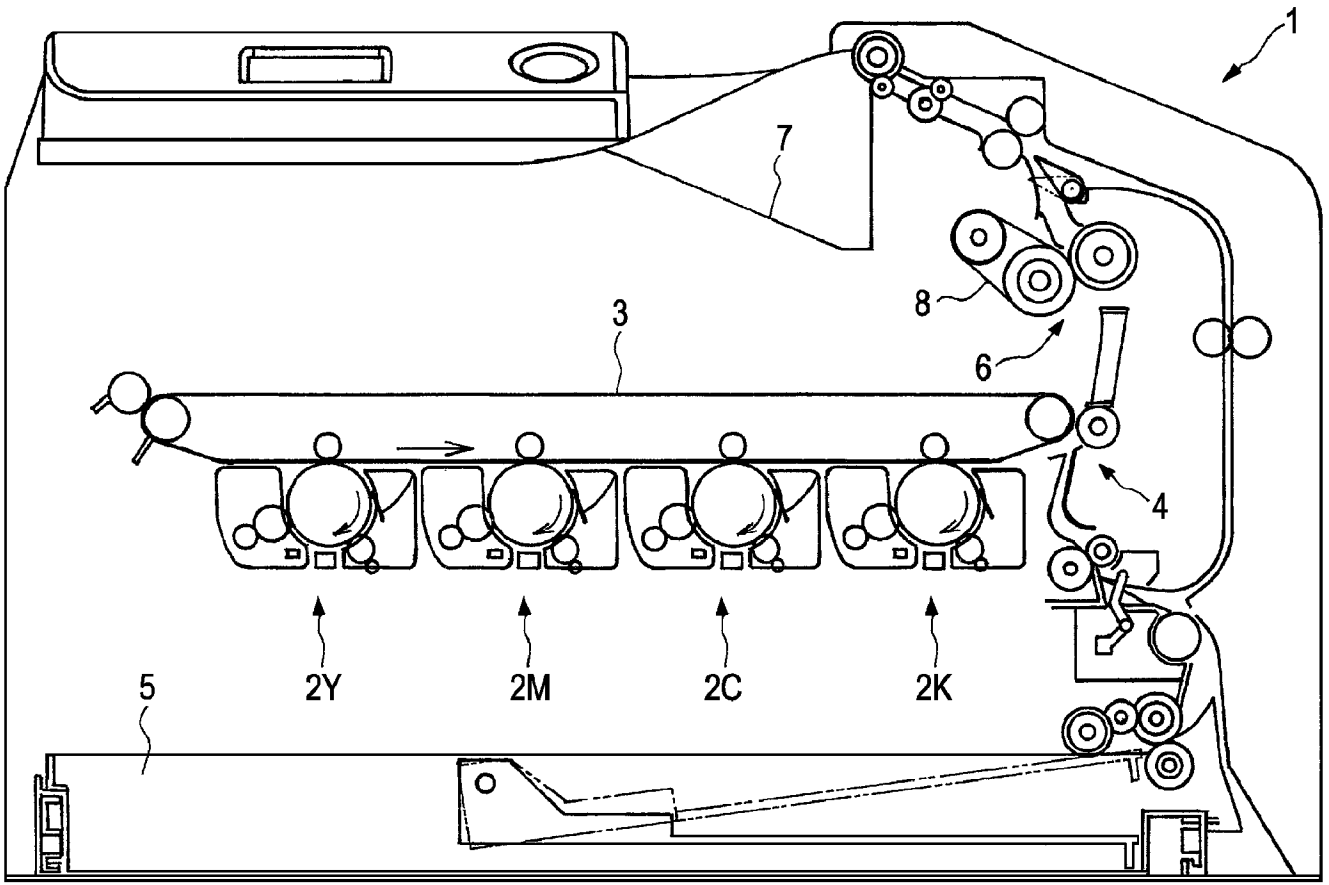
FIG. 1 is a schematic view of an example of an image forming apparatus according to an embodiment of the invention.

Hereinafter, a first embodiment of the invention will be described with reference to the accompanying drawings. FIG. 1 is a schematic view of an example of an image forming apparatus according to an embodiment of the invention. As shown in FIG. 1, the image forming apparatus 1 of this example includes image forming stations 2Y, 2M, 2C and 2K of respective colors of yellow (Y), magenta (M), cyan (C) and black (K). In addition, an endless intermediate transfer belt 3 is rotatably provided in a counter-clockwise direction in FIG. 1. The image forming stations 2Y, 2M, 2C and 2K are arranged in tandem along a movement direction of a portion of the intermediate transfer belt 3 facing the image forming stations. In addition, the arrangement order of the image forming stations of the respective colors is arbitrarily set, but, in the following description, the arrangement order shown in FIG. 1 is used. The image forming stations 2Y, 2M, 2C and 2K transfer toner images of the colors corresponding thereto on a transfer belt 3 which is a transfer medium.

A transfer device 4 is provided in the vicinity of the image forming station 2K. This transfer device 4 transfers the toner image on the transfer belt 3 on a transfer material (not shown) transported from a transfer material storage device 5 of the transfer material such as paper. In addition, a fixing device 6 is provided in the vicinity of the transfer device 4. This fixing device 6 fixes the toner image on the transfer material by, for example, heating, pressurization, and fixing. The transfer material on which the image is formed is received in an ejected transfer material tray 7. In addition, in this image forming apparatus 1, the detailed configurations and the detailed operations of the image forming stations 2Y, 2M, 2C and 2K, the intermediate transfer belt 3, the transfer device 4, the transfer material storage device 5, the fixing device 6, and the ejected transfer material tray 7 are known and can be understood by referring to, for example, Japanese Patent No. 3711717 and JP-A-2008-15164 (a fixing device described in JP-A-2008-15164 is different in view of a pressurization belt), the detailed description thereof will be omitted.

Figure 2:
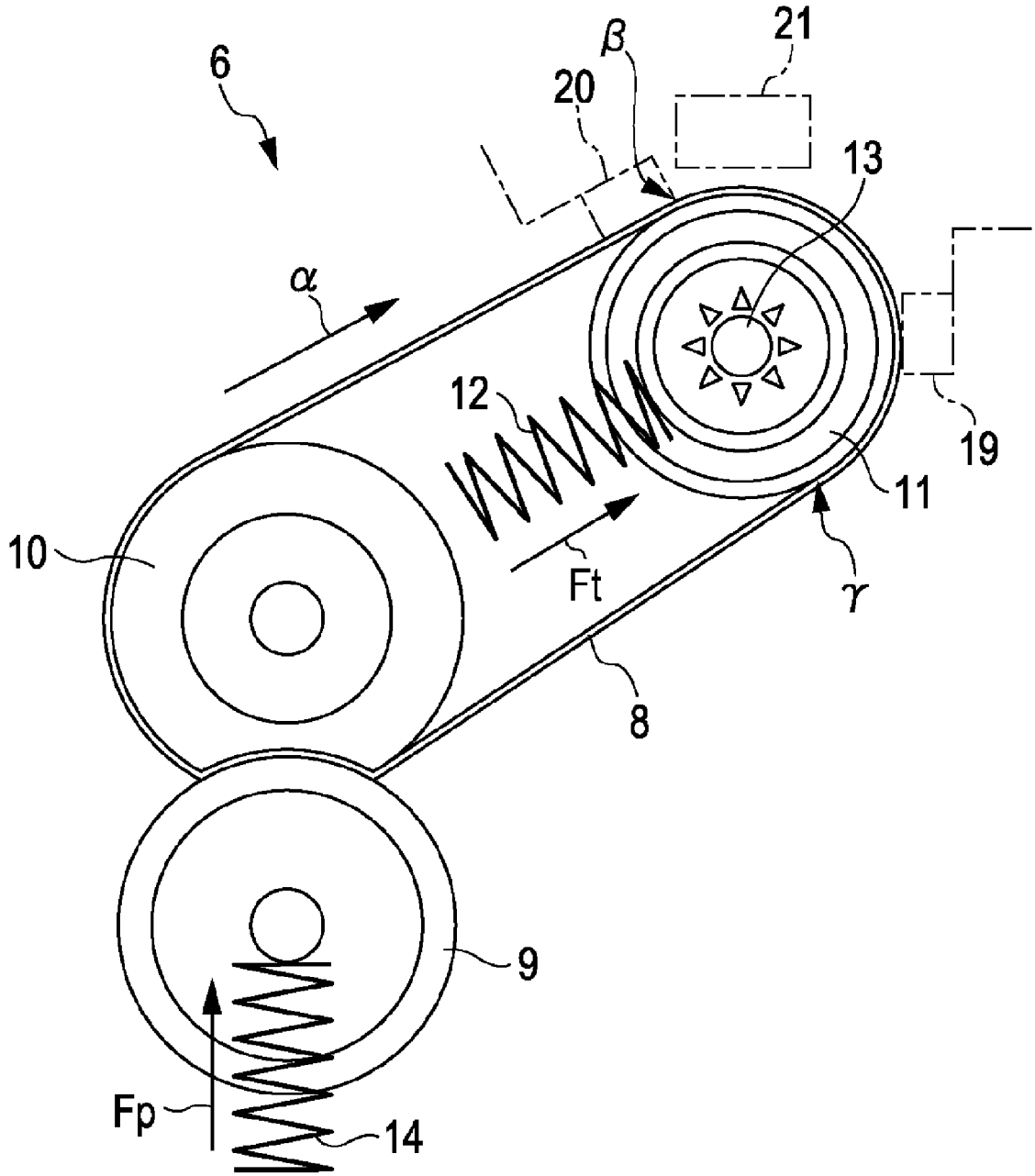
FIG. 2 is a schematic view of a fixing device of the example shown in FIG. 1.
Figure 3D:
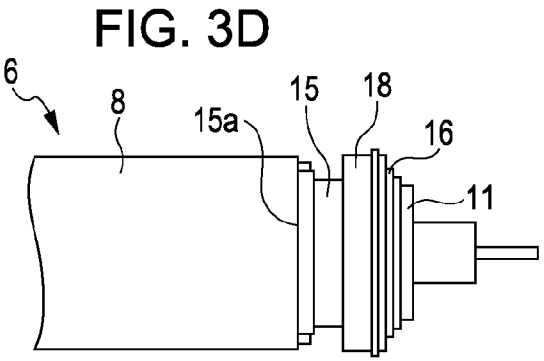
FIG. 3D is a partial top view of the fixing device.
Figure 3A:
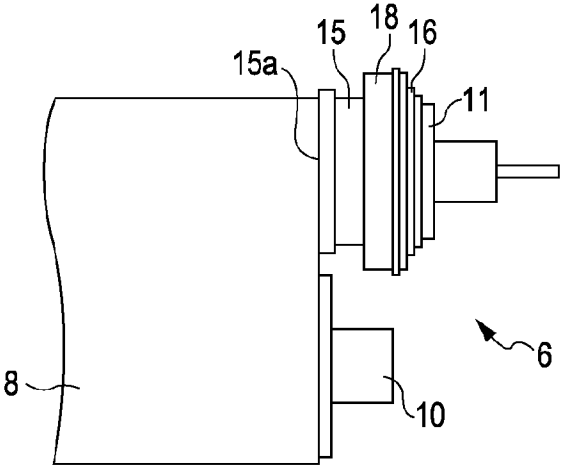
FIG. 3A is a partial front view of the fixing device.
Figure 3B:
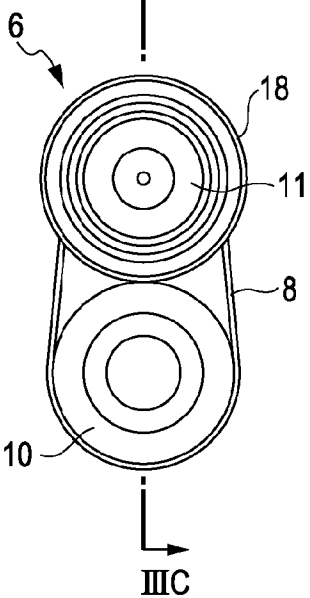
FIG. 3B is a right side view of the fixing device.
Figure 3C:
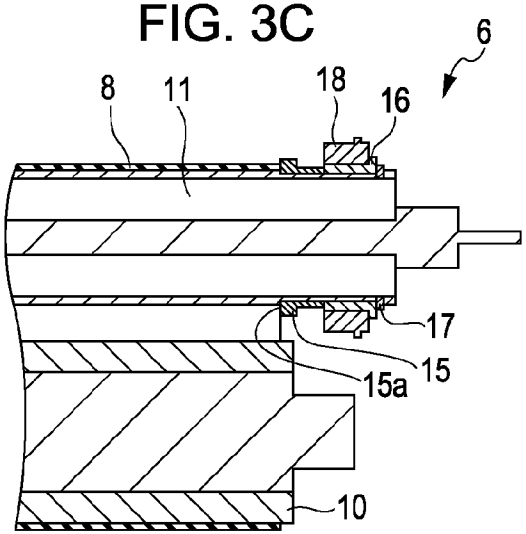
FIG. 3C is a cross-sectional view taken along the line IIIC-IIIC in FIG. 3B.

As shown in FIG. 2, the fixing device 6 includes an endless heating belt 8 and a pressurization roller 9. The heating belt 8 is stretched between a fixing roller 10, to which driving force is delivered by a driving unit such as a motor (not shown) or the like, and a heating roller 11. In this case, predetermined tension is applied to the heating belt 8 by spring force Ft of a tension applying spring 12. The heating roller 11 is formed in a cylindrical shape, and includes a heater 13 provided therein, such as a halogen heater lamp or the like. A power source (not shown) of the heater 13 is turned on such that the heating belt 8 is heated by the heat generated by the heater 13 via the heating roller 11.

The pressurization roller 9 is pressed on the heating belt 8 stretched over the fixing roller 10 by predetermined pressing force due to the spring force Fp of a pressurization spring 14. In this case, since the fixing roller 10 and the heating belt 8 are softer than the pressurization roller 9, in a nip portion (pressing portion) between the pressurization roller 9 and the heating belt 8, the fixing roller 10 and the heating belt 8 are recessed. A transfer material, on which a toner image is transferred, passes through the nip portion of the heating belt 8 and the pressurization roller 9, which are rotated in a rotation direction a and are heated, in a state of being heated and pressed such that toner image is fixed on the transfer material.

As shown in FIGS. 3A to 3D, a guide ring 15 (corresponding to a bias preventing unit of the invention) having a guide surface 15*a* in one edge thereof is provided on the heating roller 11. This guide ring 15 is wound on the outer circumferential surface of the heating roller 11 and the guide surface 15*a* is in contact with the edge of the heating belt 8 so as to prevent the bias of the heating belt 8. In addition, a heat insulating bush 16 is wound on the outer circumferential surface of the heating roller 11 in a state of being in contact with an edge of the guide ring 15 on the side opposite to the guide surface 15*a*. An edge of the heat insulating bush 16 on the side opposite to the guide ring 15 is axially fixed by a locking ring 17 fixed to the heating roller 11. By this configuration, the guide ring 15 and the heat insulating bush 16 are axially positioned with respect to the heating roller 11. In addition, the heat insulating bush 16 is rotatably and movably supported on a frame (not shown) of the fixing device 6 in a direction along a line of action of the spring force Ft of the tension applying spring 12, with a bearing 18 interposed therebetween.

In addition, although only the guide ring 15 of one end side of the heating roller 11 is shown in FIGS. 3A to 3D, the same guide ring 15 is provided on the other end side of the heating roller 11. In this case, the guide ring 15 of the other end side of the heating roller 11 passes through the center of the heating roller 11 in an axial direction and is symmetrically provided with respect to a straight line (not shown) perpendicular to the axial direction. Although not shown, the fixing roller 10 is rotatably supported on the frame of the fixing device 6 with the bearing interposed therebetween. Although not shown, the pressurization roller 9 is rotatably and movably supported on the frame of the fixing device 6 in a direction along a line of action of the spring force Fp of the pressurization spring 14, with the bearing interposed therebetween.

First belt temperature detecting devices (for example, a thermistor or the like) 19 are provided at approximately the center of the heating roller 11 in an axial direction thereof in a state of being in contact with or in the vicinity of the heating belt 8 stretched over the heating roller 11. These first belt temperature detecting devices 19 detect the surface temperature of a portion of the heating belt 8 and send the surface temperature to a control device (not shown) of the image forming apparatus. The control device controls the ON/OFF of the heater 13 on the basis of the temperature of the heating belt 8 detected by the first belt temperature detecting devices 19 such that the temperature of the heating belt 8 is held at a desired temperature during an image forming operation. Transition from a first mode to a second mode may be controlled on the basis of the temperature of the heating belt 8 detected by the first belt temperature detecting devices 19.

Second belt temperature detection devices (for example, a thermistor or the like) 20 are provided at positions close to ends of the heating roller 11 in the axial direction thereof in a state of being in contact with or in the vicinity of the heating belt 8 anterior to a stretch start position β of the heating belt 8, which is in contact with the heating roller 11. These second belt temperature detecting devices 20 detect the surface temperature of a portion of the heating belt 8 and send the surface temperature to a control device (not shown) of the image forming apparatus. The control device controls a later-described transition from the first mode to the second mode on the basis of the temperature of the heating belt 8 detected by the second belt temperature detection devices 20. Moreover, the first belt temperature detection devices 19 and the second belt temperature detection devices 20 may be arranged at positions which become the same phase with respect to the rotation direction of the heating belt 8. Further, the control device may control the ON/OFF of the heater 13 on the basis of the temperature of the heating belt 8 detected by the second belt temperature detecting devices 20. That is, the temperature of the heating belt 8 at a position thereof where the temperature becomes the lowest, on a side thereof where it is stretched over the heating roller 11, is detected by the first belt temperature detection devices 19 and the second belt temperature detection devices 20.

A third belt temperature detection device (for example, a thermostat or the like) 21 is provided in the vicinity of the heating belt 8 so as to detect the surface temperature of the heating belt 8. The third belt temperature detection device 21 turns off the power source of the heater 13 when the temperature of the heating belt 8 (that is, the temperatures of the heating roller 11 and the heater 13) becomes abnormally a high temperature by an unexpected situation. Accordingly, it is possible to prevent the adverse effect due to the abnormal increase of the temperature of the heating belt 8 (that is, the temperatures of the heating roller 11 and the heater 13) (high-temperature destroy or the like of the heating roller 11 or the heating belt 8).

In the fixing device 6 of this example, at the time of returning from a power source off state or a sleep mode, in which the power source of the heating belt 8 is turned off, the rotation of the heating belt 8 is stopped, and the belt temperature becomes a low temperature (during the non-heating and the non-rotation of the heating belt 8), to the image formation, two next modes, that is, first and second modes, are set with respect to the control of a belt heating operation and a belt rotation operation of the heating belt 8. That is, the first mode is a combination mode of the heating of the heating roller 11 and the driving stop of the fixing roller 10 (that is, the rotation stop of the heating belt 8). The second mode is a combination mode of the heating mode of the heating roller 11 and the driving of the fixing roller 10 (that is, the rotation of the heating belt 8).

At the time of returning from the power source off state or the sleep mode, the control device of the image forming apparatus 1 first performs the heating control of the heating roller 11 and the driving control of the heating roller 8 using a driving unit by the first mode. That is, the heating roller 11 is heated and the driving of the heating belt 8 is stopped. Thereafter, the control device transitions from the first mode to the second mode and performs the control by the second mode. That is, the heating of the heating roller 11 is continuously performed and the heating belt 8 is driven. In this case, the control device performs the transition from the first mode to the second mode on the basis of the surface temperature of the heating belt 8 on a side thereof where it is stretched to the heating roller 11, which is detected by the second belt temperature detection devices 20.

At this time, a transition temperature from the first mode to the second mode (that is, the mode transition reference temperature $T_{bs}$ (° C.) in which the heating belt 8 is rotated) is set to satisfy Equation 1 (that is, Equation 2) and Equation 3. This mode transition reference temperature $T_{bs}$ (° C.) is the temperature of the heating belt 8 in which the wrinkles of the heating belt 8 generated by the low temperature state of the belt due to the power source off state or the sleep mode disappear or substantially disappear.

$$L\times(T_b-T_r)\times\alpha_{hr}-L\times(T_b-T_r)\times\alpha_b \leqq L\times(T_{bs}-T_r)\times 2\times\alpha_{hr}-L\times(T_{bs}-T_r)\times\alpha_b \quad \text{Equation 1}$$

where,

L: Width (mm) of the heating belt and width (mm) between the guide rings of the heating roller, $T_b$: Belt control temperature (° C.) of the heating belt, $T_r$: Environment temperature (° C.) (for example, a room temperature or the like, and, as a detailed value, for example 20° C.), $T_{bs}$: Mode transition temperature (° C.) of the heating belt during the transition from the first mode to the second mode, $\alpha_{hr}$: Linear expansion coefficient (1/° C.) of the heating roller, and $\alpha_b$: Linear expansion coefficient (1/° C.) of the heating belt.

When Equation 1 is changed with respect to the mode transition reference temperature $T_{bs}$, $$\frac{(\alpha_{hr}-\alpha_b)T_b+\alpha_{hr}T_r}{2\alpha_{hr}-\alpha_b} \leqq T_{bs} \quad \text{Equation 2}$$

$$T_{bs} < T_0 \quad \text{Equation 3}$$

where, $T_0$: Destroy temperature (° C.) of the heating belt.

In Equation 1, the mode transition reference temperature $T_{bs}$ is set as follows. That is, at the time of the power source off state or the sleep mode, in the low temperature state, since the contraction amount of the heating roller 11 in the axial direction is larger that of the heating belt 8 in the width direction as described above, wrinkles are generated in the heating belt 8 shown in FIG. 4A due to several concave portions 8*a*. At this time, the temperatures of the heating belt 8 and the heating roller 11 are substantially equal. In this state, when the fixing device 6 is returned to the power source off state or the sleep mode by an image forming command or the like, the heating roller 11 is heated. Accordingly, the heating belt 8 is heated by the first mode and the temperature thereof is increased. At this time, since the heating roller 11 is heated earlier than the heating belt 8, the temperature of the heating roller 11 becomes higher than the temperature of the heating belt 8 (that is, the temperature of the heating belt 8 detected by the second belt temperature detection devices 20) in the first mode. In this case, as the experiment results of the temperature measure, in the first mode, the temperature of the heating roller 11 becomes about twice of the temperature of the heating belt 8.

When the temperature of the heating belt 8 becomes the mode transition reference temperature $T_{bs}$, it is considered that the temperature of the heating roller 11 is about twice of the mode transition reference temperature $T_{bs}$. When the temperature of the heating belt 8 becomes the mode transition reference temperature $T_{bs}$, since the expansion amount of the heating roller 11 in the axial direction is large than that of the heating belt 8 in the width direction, the wrinkles in the heating belt 8 shown in FIG. 4B due to the concave portions 8*a* disappear. That is, the mode transition reference temperature $T_{bs}$ is a temperature in which the wrinkles in the heating belt 8 due to the concave portions 8*a* disappear by the heating of the heating roller 11 in the first mode.

In Equation 3, the mode transition reference temperature $T_{bs}$ is set to lower than the belt destroy temperature $T_0$ (° C.). This belt destroy temperature $T_0$ (° C.) is given as a measured value. That is, By performing a belt heating destroy experiment in a temperature range including a temperature area derived using the heating belt 8, the fixing roller 10 and the heating roller 11 used in the fixing device 6, the belt destroy temperature $T_0$ (° C.) is set. As a detailed example, the fixing device 6 is solely set or the fixing device 6 is set in the image forming apparatus 1 in a state in which the temperature can be adjusted. The heating roller 11 is heated by the same control as the returning from the power source off state of the heater 13 or the sleep mode (power saving mode), without rotating the heating belt 8. In the vicinity of the boundary between a contact portion and a non-contact portion of the heating belt 8 and the heating roller 11 (in the vicinity of the contact start position β and a contact end position γ shown in FIG. 2), the temperature of the heating belt 8 when the start of the deformation of the heating belt 8 is visually confirmed is called the belt destroy temperature (heating destroy temperature) $T_0$ (° C.).

Figure 5:
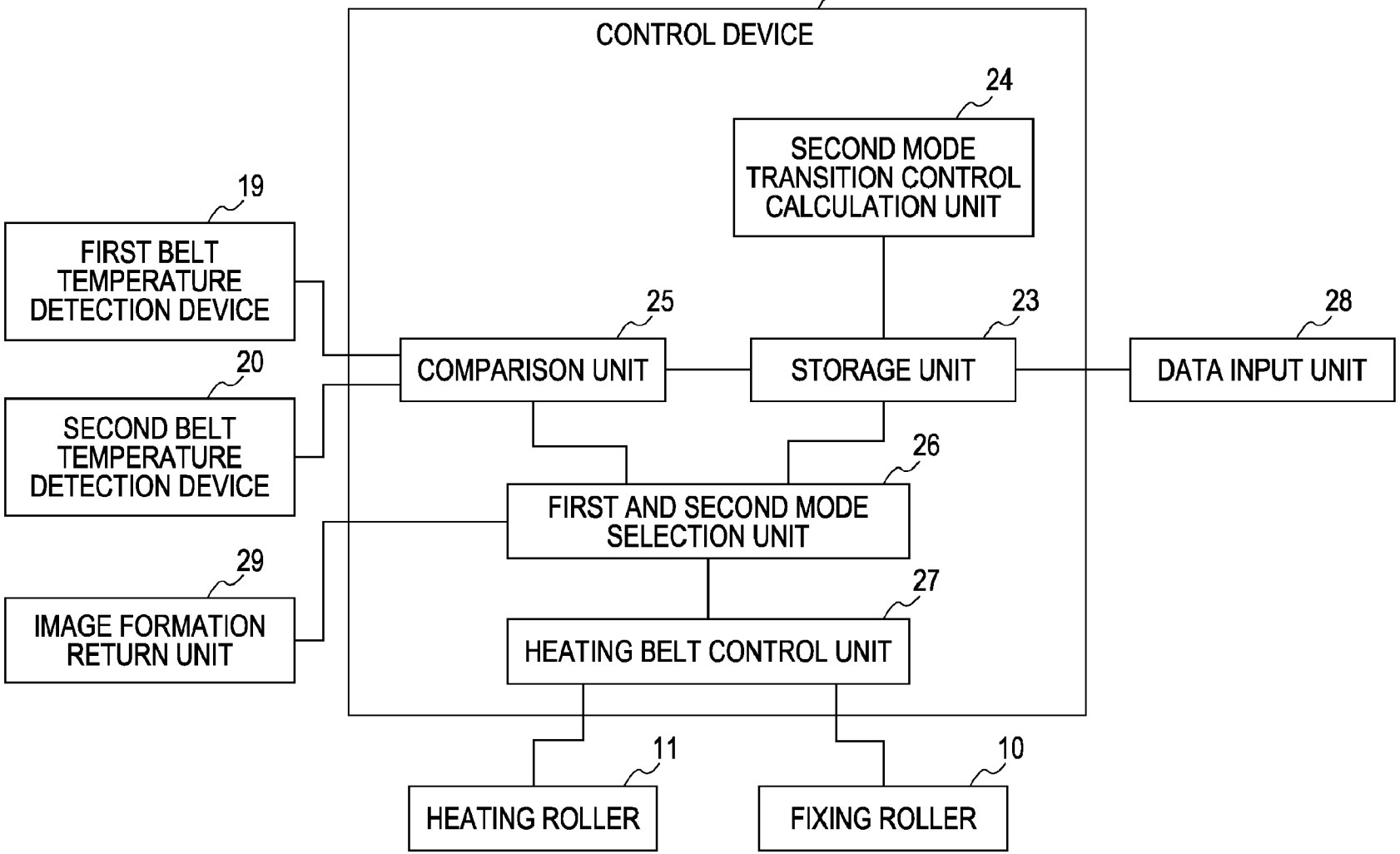
FIG. 5 is a block diagram showing an example of a first embodiment of a control device of the fixing device of the example shown in FIG. 2.

FIG. 5 is a block diagram of the control device for controlling the heating belt for image formation. As shown in FIG. 5, the control device 22 of the image forming apparatus 1 includes a storage unit 23, a second mode transition control calculation unit 24, a comparison unit 25, a first and second mode selection unit 26, and a heating belt control unit 27. The storage unit 23 is connected to a data input unit 28. When an operator such as a worker or a service man operates the data input unit 28, data is input to and stored in the storage unit 23. The data includes the width L (mm) of the heating belt 8 (the distance between the guide surfaces 15*a* of the guide rings 15 of both ends of the heating roller 11) in the fixing device 6 of the image forming apparatus 1, the belt control temperature $T_b$ (° C.) of the heating belt 8 during the image forming operation, the environment temperature $T_r$ (° C.) such as a room temperature or the like of a place where this image forming apparatus 1 is used, the mode transition temperature $T_{bs}$ (° C.) of the heating belt 8 during the transition from the first mode to the second mode, the destroy temperature $T_0$(° C.) of the heating belt 8, the linear expansion coefficient $\alpha_{hr}$(1/° C.) of the heating roller 11, the linear expansion coefficient $\alpha_b$ (1/° C.) of the heating belt 8. In addition, the storage unit 23 stores the control contents of the heating belt 8 in the above-described first and second modes.

The second mode transition control calculation unit 24 calculates the temperature of the left side of Equation 2. The second mode transition control calculation unit 24 sets a calculated value or a value slightly larger than this value as the mode transition reference temperature $T_{bs}$ (° C.) of the fixing device 6 and stores the value in the storage unit 23.

The first belt temperature detection device 19 and the second belt temperature detection devices 20 are connected to the comparison unit 25. This comparison unit 25 compares the detected belt temperatures (° C.) of the heating belt 8 detected by the first belt temperature detection devices 19 and the second belt temperature detection devices 20 with the mode transition reference temperature $T_{bs}$ (° C.) during the transition to the second mode of the storage unit 23. The comparison unit 25 outputs a mode switching signal to the first and second mode selection unit 26 when it is determined that the detected belt temperature (° C.) becomes equal to or larger than the mode transition reference temperature $T_{bs}$ (° C.).

An image formation return unit 29 is connected to the first and second mode selection mode 26. This image formation return unit 29 is provided in an operating panel of the image forming apparatus 1 and is operated by, for example, a user, for image formation, so as to output a image formation return signal for returning the image forming apparatus 1 from the power source off state or the sleep mode to the first and second mode selection unit 26. At this time, the heating belt 8 has the low temperature lower than the mode transition reference temperature $T_{bs}$ (° C.) by the power source off state or the sleep mode. Accordingly, the first and second mode selection unit 26 selects the first mode of the storage unit 23 by this image formation return signal and outputs the control contents of the first mode to the heating belt control unit 27. Then, the heating belt control unit 27 heats the heating roller 11 (that is, the heating belt 8) and holds the driving of the heating belt 8 in a stop state, according to the control contents of the first mode.

By the heating of the heating belt 8 in the first mode, the belt temperature of the heating roller 11 is increased. The belt temperature is detected and is output to the comparison unit 25. The comparison unit 25 outputs a mode switching signal to the first and second mode selection unit 26, when it is determined that the detected belt temperature from the first belt temperature detection devices 19 and the second belt temperature detection devices 20 becomes equal to or larger than the mode transition reference temperature $T_{bs}$ (° C.) from the storage unit 23. Then, the first and second mode selection unit 26 selects the second mode of the storage unit 23 by this mode switching signal and outputs the control contents of the second mode to the heating belt control unit 27. Then, the heating belt control unit 27 continuously performs the heating of the heating roller 11 (that is, the heating belt 8), drives the fixing roller 10 by the driving unit, and rotates the heating belt 8, according to the control contents of the second mode. At this time, since the temperatures of the heating roller 11 and the heating belt 8 are the mode transition reference temperature $T_{bs}$ (° C.) satisfying Equations 2 and 3, the wrinkles generated in the heating belt 8 shown in FIG. 4A disappear as shown in FIG. 4B. Therefore, even when the heating belt 8 is rotated, the crack due to overlapping of the wrinkles is prevented, so that the heating belt 8 can be smoothly rotated.

By the continuous heating of the heating belt 8 in the second mode, the belt temperature of the heating belt 8 is increased. However, since the mode transition reference temperature $T_{bs}$ (° C.) is lower than the previously measured destroy temperature $T_0$ (° C.) in which the heating belt 8 is thermally destroyed, the heating belt 8 is not destroyed when the mode transitions to the second mode and the heating belt 8 is rotated.

According to the fixing device 6 of this example, at the time of the returning of the heating belt 8 for the image forming operation from the low belt temperature state of the heating belt 8 due to the OFF state of the power source of the heating roller 11 in the power source off state or the sleep mode (power saving mode), two modes are set with respect to the heating control and the rotation control of the heating belt 8. The first mode is a combination mode of the heating of the heating belt 8 and the rotation stop of the heating belt 8. The second mode is a combination mode of the heating of the heating belt 8 and the rotation of the heating belt 8.

Accordingly, at the time of the returning of the heating belt 8, the heating belt 8 is first heated by the setting of the first mode, but the heating belt 8 is not rotated. Next, when the surface temperature of the heating belt 8 is increased to the mode transition reference temperature $T_{bs}$ by the heating of the heating roller 11, the heating of the heating belt 8 is continuously performed and the heating belt 8 is rotated, by the setting of the second mode. At this time, the winkles of the heating belt 8 disappear. Accordingly, the bias of the heating belt 8 entering the heating roller 11 can be suppressed by the guide ring 15. In addition, although the guide ring 15 presses the edge of the belt portion of the heating belt 8 in the width direction, since the wrinkles are not present in the heating belt 8, it is possible to prevent the generation of the crack in the heating belt 8. Accordingly, it is possible to adequately perform the heating, the pressurization and fixing using the fixing device 6 over a long period of time. According to the image forming apparatus 1 including the fixing device 6 of this example, since the heating, the pressurization, and the fixing can be adequately performed, it is possible to form an image with high quality over a long period of time.

Next, a detailed example of the fixing device 6 of this example will be described.

The width of the heating belt 8 and the distance L (mm) between the guide rings 15 at both ends of the heating roller 11 are set to 310 mm. The belt control temperature $T_b$ (° C.) during the image forming operation is set to 155° C. The environment temperature $T_r$ (° C.) is set to a room temperature of 20° C. The linear expansion coefficient □$\alpha_{hr}$ (1/° C.) of the heating roller 11 is set to 0.000024/° C. and the linear expansion coefficient $\alpha_b$ (1/° C.) of the heating belt 8 is set to 0.000015/° C. Therefore, the mode transition reference temperature $T_{bs}$ (° C.) of the heating belt 8 during the transition from the first mode to the second mode becomes to satisfy a relation of $T_{bs} \geqq 56.8°$ C. Therefore, in the case of this example, it may be desirable that the mode transition reference temperature $T_{bs}$ (° C.) is set to a temperature equal to or larger than 56.8° C. and lower than the measured destroy temperature $T_0$ (° C.).

Next, another example of the embodiment of the fixing device 6 according to the invention will be described.

In the fixing device 6 of the above-described embodiment, the transition from the first mode to the second mode is controlled on the basis of the mode transition reference temperature $T_{bs}$ (° C.). To the contrary, in the fixing device 6 of the embodiment of this example, the transition from the first mode to the second mode is controlled on the basis of the mode transition reference heating time $t_{bs}$ (sec) during which the heating belt 8 is heated.

That is, the mode transition reference heating time $t_{bs}$ (sec) of the heating belt 8 required for the transition from the first mode to the second mode is set to satisfy Equation 4. This mode transition reference heating time $t_{bs}$ (sec) is the heating time of the heating belt 8 in which the wrinkles of the heating belt 8 generated by the low temperature state of the belt due to the power source off state or the sleep mode disappear or substantially disappear. In calculation of the mode transition reference heating time $t_{bs}$ (sec), in addition to the mode transition reference temperature $T_{bs}$ (° C.), the calorific capacity $C_{hr}$ (KJ/K) of the heating belt 8 and the heating roller 11 and the heater wattage W (J/sec) of the heater 13 are used. The reason of using the mode transition reference heating time $t_{bs}$ (sec) is that the control of the heating belt 8 can be performed in a more accurate manner by taking the calorific capacity $C_{hr}$ (KJ/K) of the heating belt 8 and the heating roller 11 and the heater wattage W (J/sec) of the heater 13 into consideration.

$$t_{bs} \geqq C_{hr} \times T_{bs} \times (T_{bs} - T_r) \times 2/W \quad \text{Equation 4}$$

where, $t_{bs}$: Mode transition reference heating time (sec) which is a heating time required for starting the heating belt, $C_{hr}$: Calorific capacity (KJ/K) of the heating roller and the heating belt, W: Heater wattage (J/sec), and Other symbols are the same as those of Equation 5.

Figure 6:
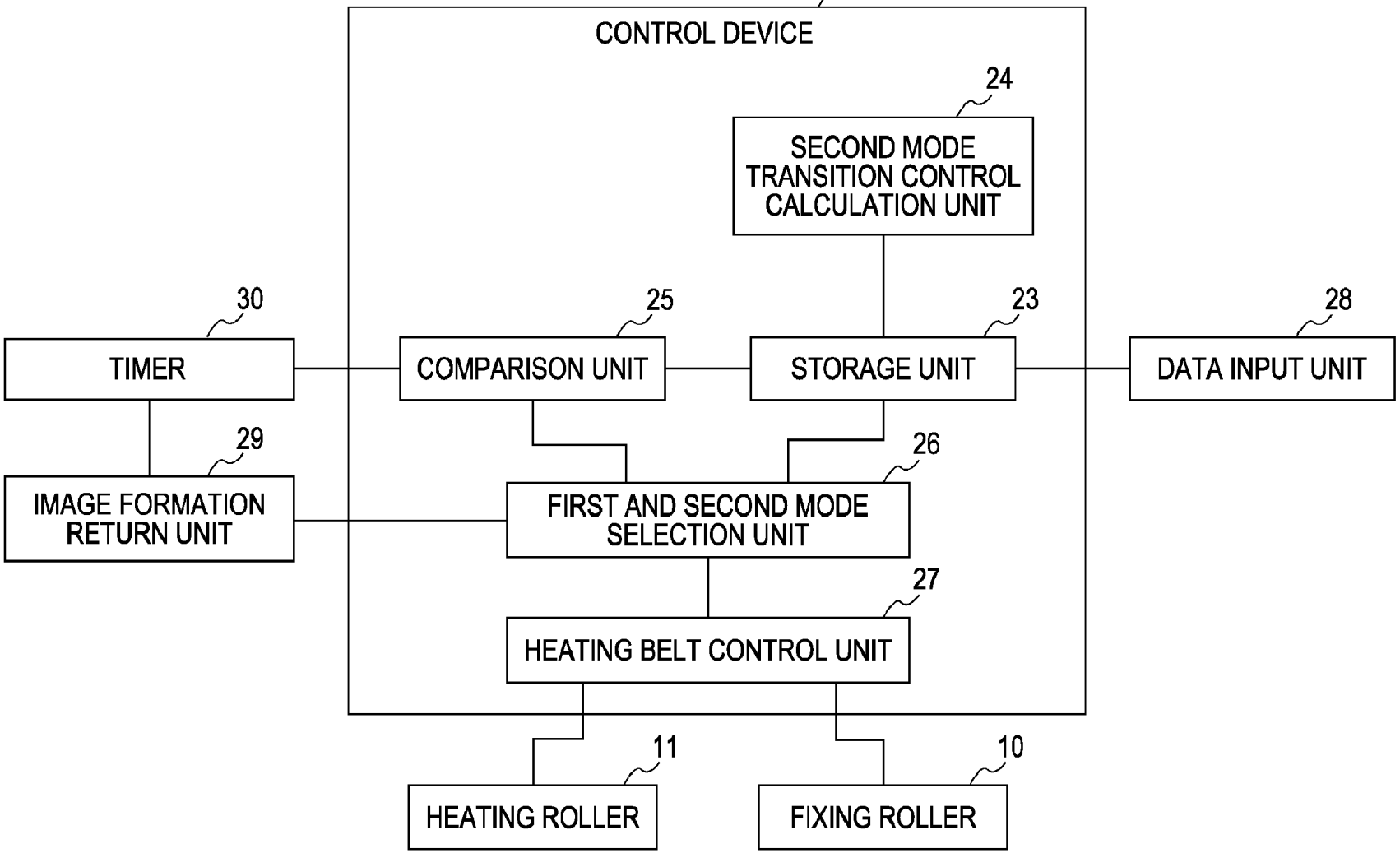
FIG. 6 is a block diagram showing another example of the first embodiment of the control device of the fixing device of the example shown in FIG. 2.

The control of the heating belt 8 using the mode transition reference heating time $t_{bs}$ (sec) is performed by the control device 22 shown in FIG. 6. In this case, the control device 22 is not provided with the first belt temperature detection units 19 and the second belt temperature detection units 20 but is provided with a timer 30. The timer 30 is supplied with an operation signal from the image formation return unit 29 during the above-described returning. Then, the timer 30 starts measuring a period of time in response to the input of the operation signal and outputs the measured period of time to the comparison unit 25. Moreover, similar to the above-described example, the operation signal of the image formation return unit 29 is input to the first and second mode selection unit 26 as the switching signal. Therefore, similar to the above-described example, the control of the heating belt 8 by the first mode is started.

The storage unit 23 of the control device 22 has stored therein the calorific capacity $C_{hr}$ (KJ/K) of the heating belt 8 and the heating roller 11 and the heater wattage W (J/sec) of the heater 13. The second mode transition control calculation unit 24 calculates the mode transition reference temperature $T_{bs}$ (° C.) on the basis of Equation 2 and calculates the time of the right side of Equation 4. Further, the calculated time of the right side of Equation 4 or a period of time slightly longer than the calculated time is set as the mode transition reference heating time $t_{bs}$ (sec) and stored in the storage unit 23. When the time measured by the timer 30 reaches the mode transition reference heating time $t_{bs}$ (sec), the comparison unit 25 outputs the switching signal to the first and second mode selection unit 26. Thereafter, similar to the above-described example, the heating belt 8 is controlled by the second mode.

Further, in the control of the heating belt 8 using the mode transition reference heating time $t_{bs}$ (sec), the belt destroy temperature $T_0$ (° C.) of the above-described example is used. Other configurations and other operations of the fixing device 6, the control device 22 and the image forming apparatus 1 of this example are the same as those of the above-described example.

Second Embodiment

Hereinafter, a second embodiment of the invention will be described with reference to the accompanying drawings. The same constituent elements as those of the first embodiment will be referenced by the same reference numerals. Since the fixing device of the second embodiment has the same configuration as the fixing device of the first embodiment, except that their control-related configurations are different, the description of the same configuration will be omitted.

Second belt temperature detection devices (for example, a thermistor or the like) 20 are provided at positions close to ends of the heating roller 11 in the axial direction thereof in a state of being in contact with or in the vicinity of the heating belt 8 anterior to a stretch start position β of the heating belt 8, which is in contact with the heating roller 11. These second belt temperature detecting devices 20 detect the surface temperature of a portion of the heating belt 8 and send the surface temperature to a control device (not shown) of the image forming apparatus. The control device controls a later-described transition from the first mode to the second mode on the basis of the temperature of the heating belt 8 detected by the second belt temperature detection devices 20. The first belt temperature detection devices 19 and the second belt temperature detection devices 20 may be arranged at positions which become the same phase with respect to the rotation direction of the heating belt 8. Further, the control device may control the ON/OFF of the heater 13 on the basis of the temperature of the heating belt 8 detected by the second belt temperature detecting devices 20. That is, the temperature of the heating belt 8 at a position thereof where the temperature becomes the lowest, on a side thereof where it is stretched over the heating roller 11, is detected by the first belt temperature detection devices 19 and the second belt temperature detection devices 20.

A third belt temperature detection device (for example, a thermostat or the like) 21 is provided in the vicinity of the heating belt 8 so as to detect the surface temperature of the heating belt 8. The third belt temperature detection device 21 turns off the power source of the heater 13 when the temperature of the heating belt 8 (that is, the temperatures of the heating roller 11 and the heater 13) becomes abnormally a high temperature by an unexpected situation. Accordingly, it is possible to prevent the adverse effect due to the abnormal increase of the temperature of the heating belt 8 (that is, the temperatures of the heating roller 11 and the heater 13) (high-temperature destroy or the like of the heating roller 11 or the heating belt 8).

In the fixing device 6 of this example, at the time of returning from a power source off state or a sleep mode, in which the power source of the heating belt 8 is turned off, the rotation of the heating belt 8 is stopped, and the belt temperature becomes a low temperature (during the non-heating and the non-rotation of the heating belt 8), to the image formation, two next modes, that is, first and second modes, are set with respect to the control of a belt heating operation and a belt rotation operation of the heating belt 8. That is, the first mode is a combination mode of the heating of the heating roller 11 and the driving stop of the fixing roller 10 (that is, the rotation stop of the heating belt 8). The second mode is a combination mode of the heating mode of the heating roller 11 and the driving of the fixing roller 10 (that is, the rotation of the heating belt 8).

At the time of returning from the power source off state or the sleep mode, the control device of the image forming apparatus 1 first performs the heating control of the heating roller 11 and the driving control of the heating belt 8 using a driving unit by the first mode. That is, the heating roller 11 is heated and the driving of the heating belt 8 is stopped. Thereafter, the control device transitions from the first mode to the second mode and performs the control by the second mode. That is, the heating of the heating roller 11 is continuously performed and the heating belt 8 is driven. In this case, the control device performs the transition from the first mode to the second mode on the basis of the surface temperature of the heating belt 8 on a side thereof where it is stretched to the heating roller 11, which is detected by the second belt temperature detection devices 20.

At this time, a transition temperature from the first mode to the second mode (that is, the mode transition reference temperature $T_{bs}$ (° C.) in which the heating belt 8 is rotated) is set to satisfy Equation 5 (that is, Equation 6) and Equation 7. This mode transition reference temperature $T_{bs}$ (° C.) is the temperature of the heating belt 8 in which the wrinkles of the heating belt 8 generated by the low temperature state of the belt due to the power source off state or the sleep mode disappear or substantially disappear.

$$L\times(T_b-T_r)\times\alpha_{hr}-L\times(T_b-T_r)\times\alpha_b\leqq L\times(T_{bs}-T_r)\times 2\times\alpha_{hr}-L\times(T_{bs}-T_r)\times\alpha_b \quad \text{Equation 5}$$

where,

L: Width (mm) of the heating belt and width (mm) between the guide rings of the heating roller, $T_b$: Belt control temperature (° C.) of the heating belt, $T_r$: Temperature (° C.) of the heating belt at the time of the start of the first mode, $T_{bs}$: Mode transition temperature (° C.) of the heating belt during the transition from the first mode to the second mode, $\alpha_{hr}$: Linear expansion coefficient (1/° C.) of the heating roller, and $\alpha_b$: Linear expansion coefficient (1/° C.) of the heating belt.

When Equation 5 is changed with respect to the mode transition reference temperature $T_{bs}$, $$\frac{(\alpha_{hr}-\alpha_b)T_b+\alpha_{hr}T_r}{2\alpha_{hr}-\alpha_b}\leqq T_{bs} \quad \text{Equation 6}$$

$$T_{bs}<T_0 \quad \text{Equation 7}$$

where, $T_0$: Destroy temperature (° C.) of the heating belt.

In Equation 5, the mode transition reference temperature $T_{bs}$ is set as follows. That is, at the time of the power source off state or the sleep mode, in the low temperature state, since the contraction amount of the heating roller 11 in the axial direction is larger that of the heating belt 8 in the width direction as described above, wrinkles are generated in the heating belt 8 shown in FIG. 4A due to several concave portions 8*a*. At this time, the temperatures of the heating belt 8 and the heating roller 11 are substantially equal. In this state, when the fixing device 6 is returned to the power source off state or the sleep mode by an image forming command or the like, the heating roller 11 is heated. Accordingly, the heating belt 8 is heated by the first mode and the temperature thereof is increased. At this time, since the heating roller 11 is heated earlier than the heating belt 8, the temperature of the heating roller 11 becomes higher than the temperature of the heating belt 8 (that is, the temperature of the heating belt 8 detected by the second belt temperature detection devices 20) in the first mode. In this case, as the experiment results of the temperature measure, in the first mode, the temperature of the heating roller 11 becomes about twice of the temperature of the heating belt 8.

When the temperature of the heating belt 8 becomes the mode transition reference temperature $T_{bs}$, it is considered that the temperature of the heating roller 11 is about twice of the mode transition reference temperature $T_{bs}$. When the temperature of the heating belt 8 becomes the mode transition reference temperature $T_{bs}$, since the expansion amount of the heating roller 11 in the axial direction is large than that of the heating belt 8 in the width direction, the wrinkles in the heating belt 8 shown in FIG. 4B due to the concave portions 8*a* disappear. That is, the mode transition reference temperature $T_{bs}$ is set on the basis of the temperature of the heating belt 8 at the time of the start of the first mode and is a temperature in which the wrinkles in the heating belt 8 due to the concave portions 8*a* disappear by the heating of the heating roller 11 in the first mode.

In Equation 7, the mode transition reference temperature $T_{bs}$ is set to lower than the belt destroy temperature $T_0$ (° C.). This belt destroy temperature $T_0$ (° C.) is given as a measured value. That is, By performing a belt heating destroy experiment in a temperature range including a temperature area derived using the heating belt 8, the fixing roller 10 and the heating roller 11 used in the fixing device 6, the belt destroy temperature $T_0$ (° C.) is set. As a detailed example, the fixing device 6 is solely set or the fixing device 6 is set in the image forming apparatus 1 in a state in which the temperature can be adjusted. The heating roller 11 is heated by the same control as the returning from the power source off state of the heater 13 or the sleep mode (power saving mode), without rotating the heating belt 8. In the vicinity of the boundary between a contact portion and a non-contact portion of the heating belt 8 and the heating roller 11 (in the vicinity of the contact start position β and a contact end position γ shown in FIG. 2), the temperature of the heating belt 8 when the start of the deformation of the heating belt 8 is visually confirmed is called the belt destroy temperature (heating destroy temperature) $T_0$ (° C.).

Figure 7:
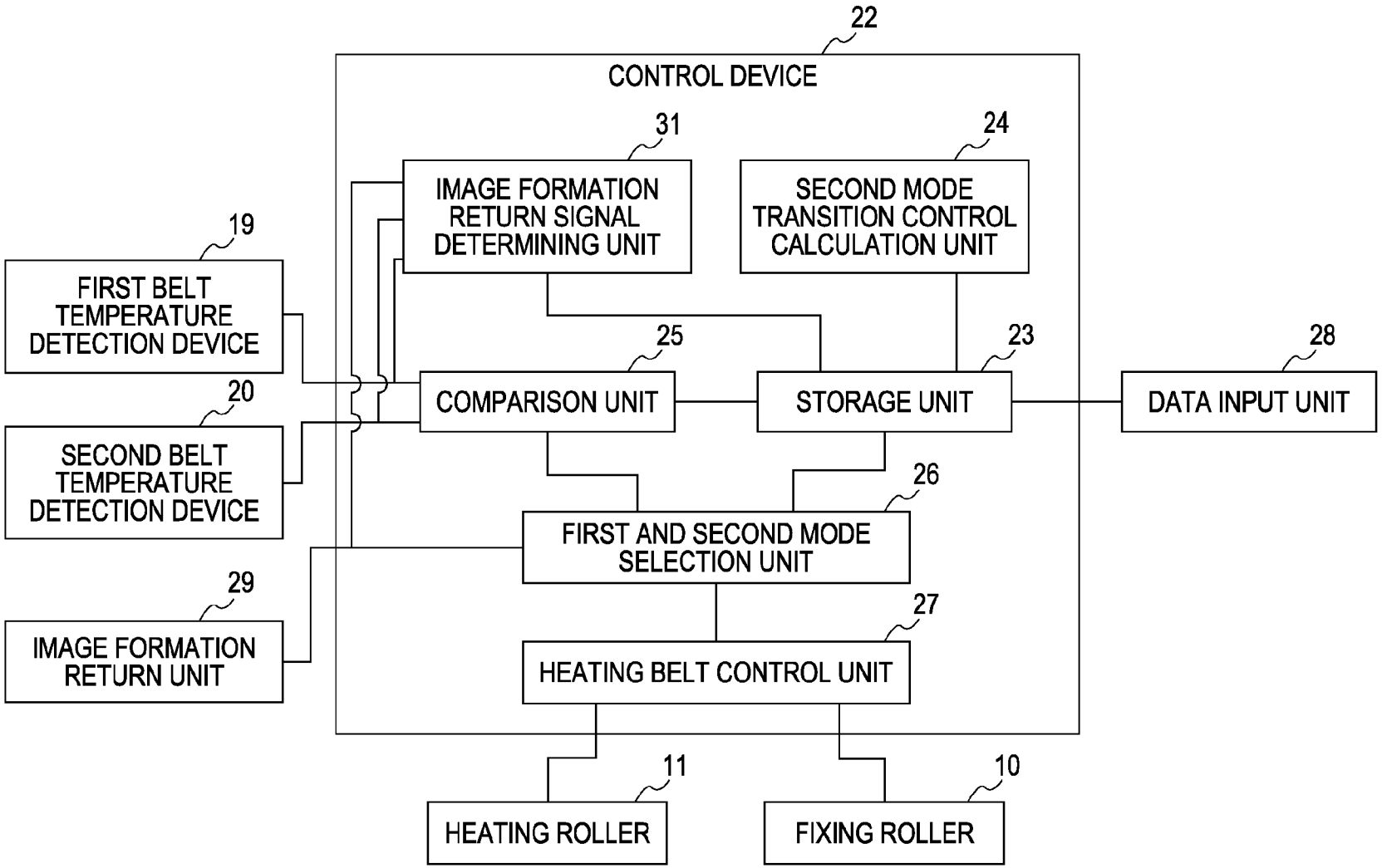
FIG. 7 is a block diagram showing an example of a second embodiment of a control device of the fixing device of the example shown in FIG. 2.

FIG. 7 is a block diagram of the control device for controlling the heating belt for image formation. As shown in FIG. 7, the control device 22 of the image forming apparatus 1 includes a storage unit 23, a second mode transition control calculation unit 24, a comparison unit 25, a first and second mode selection unit 26, a heating belt control unit 27, and an image formation return signal determining unit 31. The storage unit 23 is connected to a data input unit 28. When an operator such as a worker or a service man operates the data input unit 28, data is input to and stored in the storage unit 23. The data includes the width L (mm) of the heating belt 8 (the distance between the guide surfaces 15*a* of the guide rings 15 at both ends of the heating roller 11) in the fixing device 6 of the image forming apparatus 1, the belt control temperature $T_b$ (° C.) of the heating belt 8 during the image forming operation, the temperature $T_r$ (° C.) of the heating belt 8 at the time of the start of the control of the heating belt 8 by the first mode, the mode transition reference temperature $T_{bs}$ (° C.) of the heating belt 8 during the transition from the first mode to the second mode, the destroy temperature $T_0$ (° C.) of the heating belt 8, the linear expansion coefficient $\alpha_{hr}$ (1/° C.) of the heating roller 11, and the linear expansion coefficient $\alpha_b$ (1/° C.) of the heating belt 8. In addition, the storage unit 23 stores the control contents of the heating belt 8 in the above-described first and second modes.

The second mode transition control calculation unit 24 calculates the temperature of the left side of Equation 6. The second mode transition control calculation unit 24 sets a calculated value or a value slightly larger than this value as the mode transition reference temperature $T_{bs}$ (° C.) of the fixing device 6 and stores the value in the storage unit 23.

The first belt temperature detection device 19 and the second belt temperature detection devices 20 are connected to the comparison unit 25. This comparison unit 25 compares the lower one of the detected belt temperatures (° C.) of the heating belt 8 detected by the first belt temperature detection devices 19 and the second belt temperature detection devices 20 with the mode transition reference temperature $T_{bs}$ (° C.) during the transition to the second mode of the storage unit 23. The comparison unit 25 outputs a mode switching signal to the first and second mode selection unit 26 when it is determined that the detected belt temperature (° C.) becomes equal to or larger than the mode transition reference temperature $T_{bs}$ (° C.).

An image formation return unit 29 is connected to the first and second mode selection mode 26. This image formation return unit 29 is provided in an operating panel of the image forming apparatus 1 and is operated by, for example, a user, for image formation, so as to output a return signal for returning the image forming apparatus 1 from the power source off state or the sleep mode to the first and second mode selection unit 26. At this time, the heating belt 8 has the low temperature lower than the mode transition reference temperature $T_{bs}$ (° C.) by the power source off state or the sleep mode. Accordingly, the first and second mode selection unit 26 selects the first mode of the storage unit 23 by this return signal and outputs the control contents of the first mode to the heating belt control unit 27. Then, the heating belt control unit 27 heats the heating roller 11 (that is, the heating belt 8) and holds the driving of the heating belt 8 in a stop state, according to the control contents of the first mode.

The image formation return signal from the image formation return unit 29 is also supplied to the image formation return signal determining unit 31. In response to the input of the image formation return signal, the image formation return signal determining unit 31 stores the lower one of the detected temperatures of the heating belt 8 supplied from the first belt temperature detection devices 19 and the second belt temperature detection devices 20 to the storage unit 23. That is, the storage unit 23 stores the temperature of the heating belt 8 at the time of the start of the control of the heating belt 8 by the first mode. Moreover, as described above, the mode transition reference temperature $T_{bs}$ (° C.) is set on the basis of a value obtained by the second mode transition control calculation unit 24 calculating the value using the temperature $T_r$ (° C.) of the heating belt 8 at the time of the start of the control of the heating belt 8 by the first mode.

By the heating of the heating belt 8 in the first mode, the belt temperature of the heating belt 11 is increased. The belt temperature is detected and is output to the comparison unit 25. The comparison unit 25 outputs a mode switching signal to the first and second mode selection unit 26, when it is determined that the detected belt temperature from the first belt temperature detection devices 19 and the second belt temperature detection devices 20 becomes equal to or larger than the mode transition reference temperature $T_{bs}$ (° C.) from the storage unit 23. Then, the first and second mode selection unit 26 selects the second mode of the storage unit 23 by this mode switching signal and outputs the control contents of the second mode to the heating belt control unit 27. Then, the heating belt control unit 27 continuously performs the heating of the heating roller 11 (that is, the heating belt 8), drives the fixing roller 10 by the driving unit, and rotates the heating belt 8, according to the control contents of the second mode. At this time, since the temperatures of the heating roller 11 and the heating belt 8 are the mode transition reference temperature $T_{bs}$ (° C.) satisfying Equations 6 and 7, the wrinkles generated in the heating belt 8 shown in FIG. 4A due to the concave portions 8*a* disappear as shown in FIG. 4B. Therefore, even when the heating belt 8 is rotated, the crack due to overlapping of the wrinkles is prevented, so that the heating belt 8 can be smoothly rotated.

By the continuous heating of the heating belt 8 in the second mode, the belt temperature of the heating belt 8 is increased. However, since the mode transition reference temperature $T_{bs}$ (° C.) is lower than the previously measured destroy temperature $T_0$ (° C.) in which the heating belt 8 is thermally destroyed, the heating belt 8 is not destroyed when the mode transitions to the second mode and the heating belt 8 is rotated.

According to the fixing device 6 of this example, at the time of the returning of the heating belt 8 for the image forming operation from the low belt temperature state of the heating belt 8 due to the OFF state of the power source of the heating roller 11 in the power source off state or the sleep mode (power saving mode), two modes are set with respect to the heating control and the rotation control of the heating belt 8. The first mode is a combination mode of the heating of the heating belt 8 and the rotation stop of the heating belt 8. The second mode is a combination mode of the heating of the heating belt 8 and the rotation of the heating belt 8. In this case, the mode transition reference temperature $T_{bs}$ (° C.) is set on the basis of the temperature of the heating belt 8 at the time of the start of the control of the heating belt 8 by the first mode.

Accordingly, at the time of the returning of the heating belt 8, the heating belt 8 is first heated by the setting of the first mode, but the heating belt 8 is not rotated. Next, when the surface temperature of the heating belt 8 is increased to the mode transition reference temperature $T_{bs}$ (° C.), which is set on the basis of the temperature of the heating belt 8 at the time of the start of the control of the heating belt 8 by the first mode, by the heating of the heating roller 11, the heating of the heating belt 8 is continuously performed and the heating belt 8 is rotated, by the setting of the second mode. At this time, the winkles of the heating belt 8 disappear.

In such a case, at the time of the start of the control of the heating belt 8 by the first mode, if the temperature of the heating belt 8 is high (e.g., when the image forming apparatus 1 is used under high-temperature environment of 35° C. or higher; when the sleep mode is released during decrease in the temperature of the heating belt 8 in which the image forming operation ends and it transitions to the sleep mode; or the like), there is a possibility that the second mode is started before the wrinkles occurred in the heating belt 8 disappear. However, in this example, since the mode transition reference temperature $T_{bs}$ (° C.) is set on the basis of the temperature of the heating belt 8 at the time of the start of the control of the heating belt 8 by the first mode, the heating belt 8 can be adequately heated. Accordingly, even when the temperature of the heating belt 8 is high at the time of the start of the control of the heating belt 8 by the first mode, the heating and the rotation of the heating belt 8 by the second mode can be performed after the wrinkles of the heating belt 8 are certainly disappeared.

On the other hand, at the time of the start of the control of the heating belt 8 by the first mode, if the temperature of the heating belt 8 is low (e.g., when the image forming apparatus 1 is used under low-temperature environment of 10° C. or lower, or the like), a temperature difference occurs in the heating belt 8 at the time of the start of the second mode. That is, a large temperature difference occurs between a high-temperature portion of the heating belt 8 which is wound on the heating roller 11 and a low-temperature portion of the heating belt 8 which is not wound on the heating roller 11. Due to the large temperature difference, adverse effects such as the thermal destruction of the heating belt 8, the damage of the end of the high-temperature portion of the heating belt 8, or a concave deformation of a central portion in the width direction of the heating belt 8, are caused. However, since the mode transition reference temperature $T_{bs}$ (° C.) is set on the basis of the temperature of the heating belt 8 at the time of the start of the control of the heating belt 8 by the first mode, the heating roller 11 can be adequately heated. Accordingly, even when the temperature of the heating belt 8 at the time of the start of the control of the heating belt 8 by the first mode is low, the heating and the rotation of the heating belt 8 by the second mode can be performed without causing such adverse effects.

Accordingly, the bias of the heating belt 8 entering the heating roller 11 can be suppressed by the guide ring 15. In addition, regardless of use environment of the image forming apparatus 1, although the guide ring 15 presses the edge of the belt portion of the heating belt 8 in the width direction, since the wrinkles are not present in the heating belt 8, it is possible to prevent the generation of the crack in the heating belt 8. Accordingly, it is possible to adequately perform the heating, the pressurization and fixing using the fixing device 6 over a long period of time. According to the image forming apparatus 1 including the fixing device 6 of this example, since the heating, the pressurization, and the fixing can be adequately performed, it is possible to form an image with high quality over a long period of time.

Next, a detailed example of the fixing device 6 of this example will be described.

The width of the heating belt 8 and the distance L (mm) between the guide rings 15 at both ends of the heating roller 11 are set to 310 mm. The belt control temperature $T_b$ (° C.) during the image forming operation is set to 155° C. The temperature $T_r$ (° C.) of the heating belt 8 in the low-temperature state at the time of the start of the first mode is set to 20° C. The linear expansion coefficient $\alpha_{hr}$ (1/° C.) of the heating roller 11 is set to 0.000024/° C. and the linear expansion coefficient $\alpha_b$ (1/° C.) of the heating belt 8 is set to 0.000015/° C. Therefore, the mode transition reference temperature $T_{bs}$ (° C.) of the heating belt 8 during the transition from the first mode to the second mode becomes to satisfy a relation of $T_{bs} \geqq 56.8°$ C. Therefore, in the case of this example, it may be desirable that the mode transition reference temperature $T_{bs}$ (° C.) is set to a temperature equal to or larger than 56.8° C. and lower than the measured destroy temperature $T_0$ (° C.).

Next, another example of the embodiment of the fixing device 6 according to the invention will be described.

In the fixing device 6 of the above-described embodiment, the transition from the first mode to the second mode is controlled on the basis of the mode transition reference temperature $T_{bs}$ (° C.). To the contrary, in the fixing device 6 of the embodiment of this example, the transition from the first mode to the second mode is controlled on the basis of the mode transition reference heating time $t_{bs}$ (sec) during which the heating belt 8 is heated.

That is, the mode transition reference heating time $t_{bs}$ (sec) of the heating belt 8 required for the transition from the first mode to the second mode is set to satisfy Equation 8. This mode transition reference heating time $t_{bs}$ (sec) is the heating time of the heating belt 8 in which the wrinkles of the heating belt 8 generated by the low temperature state of the belt due to the power source off state or the sleep mode disappear or substantially disappear. In calculation of the mode transition reference heating time $t_{bs}$ (sec), in addition to the mode transition reference temperature $T_{bs}$ (° C.), the calorific capacity $C_{hr}$ (KJ/K) of the heating belt 8 and the heating roller 11 and the heater wattage W (J/sec) of the heater 13 are used. The reason of using the mode transition reference heating time $t_{bs}$ (sec) is that the control of the heating belt 8 can be performed in a more accurate manner by taking the calorific capacity $C_{hr}$ (KJ/K) of the heating belt 8 and the heating roller 11 and the heater wattage W (J/sec) of the heater 13 into consideration.

$$t_{bs} \geqq C_{hr} \times T_{bs} \times (T_{bs} - T_r) \times 2/W \qquad \text{Equation 8}$$

where, $t_{bs}$: Mode transition reference heating time (sec) which is a heating time required for the start of the heating belt, $C_{hr}$: Calorific capacity (KJ/K) of the heating roller and the heating belt, W: Heater wattage (J/sec), and Other symbols are the same as those of Equation 5.

Figure 8:
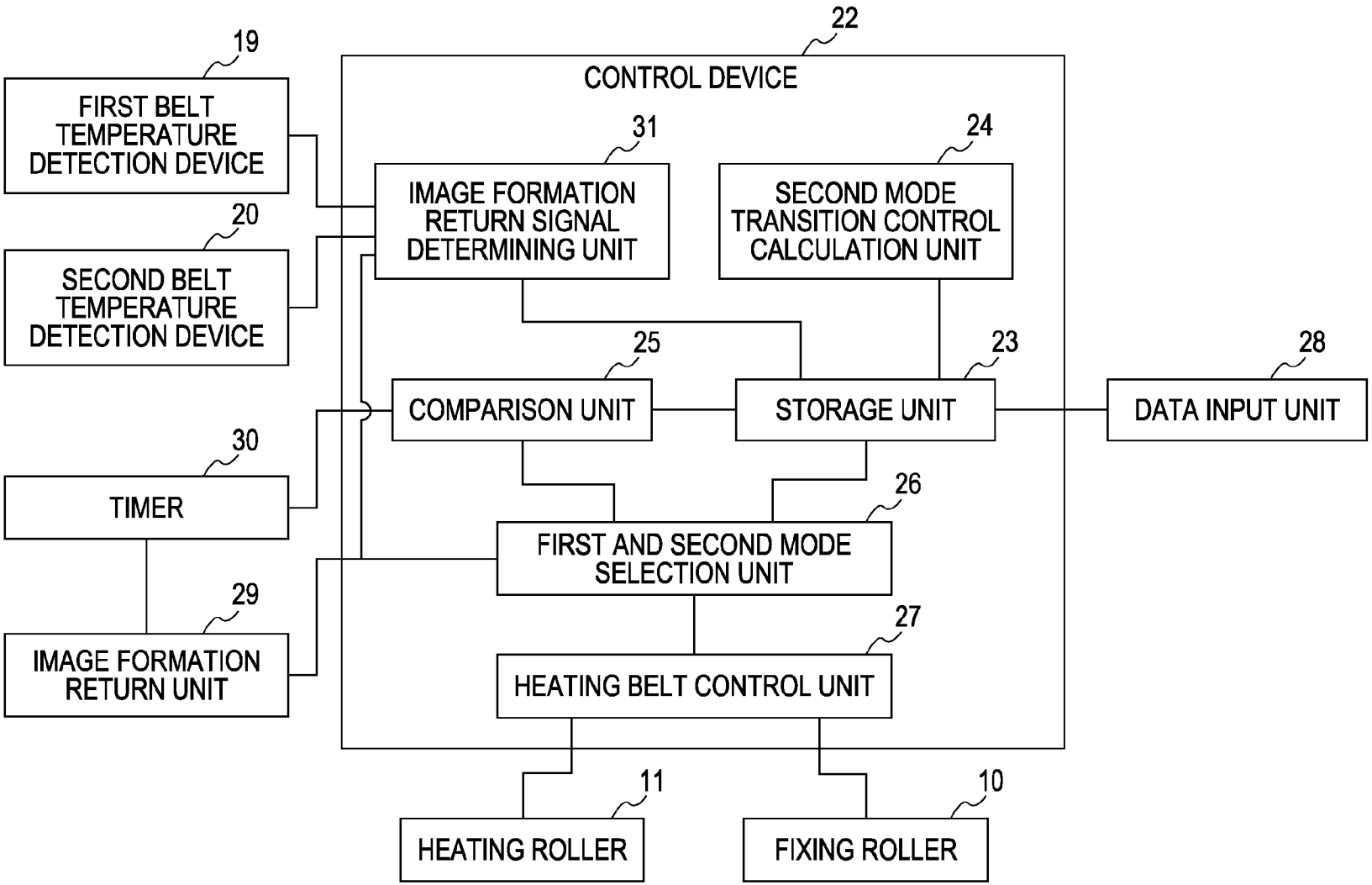
FIG. 8 is a block diagram showing another example of the second embodiment of the control device of the fixing device of the example shown in FIG. 2.

The control of the heating belt 8 using the mode transition reference heating time $t_{bs}$ (sec) is performed by the control device 22 shown in FIG. 8. In this case, the control device 22 is provided with a timer 30. The timer 30 is supplied with an operation signal from the image formation return unit 29 during the above-described returning. Then, the timer 30 starts measuring a period of time in response to the input of the operation signal and outputs the measured period of time to the comparison unit 25. Moreover, similar to the above-described example, the operation signal of the image formation return unit 29 is input to the first and second mode selection unit 26 as the switching signal. Therefore, similar to the above-described example, the control of the heating belt 8 by the first mode is started.

The storage unit 23 of the control device 22 has stored therein the calorific capacity $C_{hr}$ (KJ/K) of the heating belt 8 and the heating roller 11 and the heater wattage W (J/sec) of the heater 13. The second mode transition control calculation unit 24 calculates the mode transition reference temperature $T_{bs}$ (° C.) on the basis of Equation 2 and calculates the time of the right side of Equation 8. Further, the calculated time of the right side of Equation 8 or a period of time slightly longer than the calculated time is set as the mode transition reference heating time $t_{bs}$ (sec) and stored in the storage unit 23. When the time measured by the timer 30 reaches the mode transition reference heating time $t_{bs}$ (sec), the comparison unit 25 outputs the switching signal to the first and second mode selection unit 26. Thereafter, similar to the above-described example, the heating belt 8 is controlled by the second mode.

Further, in the control of the heating belt 8 using the mode transition reference heating time $t_{bs}$ (sec), the belt destroy temperature $T_0$ (° C.) of the above-described example is used. Other configurations and other operations of the fixing device 6, the control device 22 and the image forming apparatus 1 of this example are the same as those of the above-described example.

Third Embodiment

Hereinafter, a third embodiment of the invention will be described with reference to the accompanying drawings. The same constituent elements as those of the first and second embodiments will be referenced by the same reference numerals. Since the fixing device of the third embodiment has the same configuration as the fixing devices of the first and second embodiments, except that their control-related configurations are different, the description of the same configuration will be omitted.

Second belt temperature detection devices (for example, a thermistor (thermocouple) or the like) 20 are provided in a state of being in contact with or in the vicinity of the heating belt 8 anterior to a contact start position β which is in contact with the heating roller 11. In this case, although not shown, the second belt temperature detection devices 20 are arranged at two places. That is, the second belt temperature detection devices 20 are arranged at positions corresponding to a central portion of the heating belt 8 in a width direction and any one end of both ends of the heating belt 8 in the width direction. These second belt temperature detection devices 20 detect the surface temperature of the heating belt 8 immediately before being brought into contact with the heating roller 11 and send the surface temperature to the control device of the image forming apparatus 1. The control device calculates a mode transition reference temperature $T_{bs}$ (° C.) on the basis of a higher temperature of the temperatures of the heating belt 8 detected by the two second belt temperature detection devices 20. In addition, as the temperature of the heating belt 8, the temperature of the portion of the heating belt 8 wound on the heating roller 11, which is detected by the first belt temperature detection devices 19, as well as the temperatures detected by the second belt temperature detection devices 20 may be used. In this case, the two first belt temperature detection devices 19 are arranged on the central portion of the heating belt 8 and any one end of both ends of the heating belt 8 in the width direction, as described above. The first belt temperature detection devices 19 and the second belt temperature detection devices 20 may be arranged at positions which become the same phase with respect to the rotation direction of the heating belt 8. In this case, the first belt temperature detection devices 19 are arranged on the central portion of the heating belt 8 in the width direction, and the second belt temperature detection devices 20 are arranged on any one end of both ends of the heating belt 8 in the width direction.

A third belt temperature detection device (for example, a thermostat or the like) 21 is arranged on the side of the first belt temperature detection devices 19 rather than the second belt temperature detection devices 20 toward the rotation direction α of the heating belt 8. This third belt temperature detection device 21 is provided in the vicinity of the heating belt 8 so as to detect the surface temperature of the heating belt 8. The third belt temperature detection device 21 turns off the power source of the heater 13 when the temperature of the heating belt 8 (that is, the temperatures of the heating roller 11 and the heater 13) becomes abnormally a high temperature by an unexpected situation. Accordingly, it is possible to prevent the adverse effect due to the abnormal increase of the temperature of the heating belt 8 (that is, the temperatures of the heating roller 11 and the heater 13) (high-temperature destroy or the like of the heating roller 11 or the heating belt 8).

In the fixing device 6 of this example, at the time of returning from a power source off state or a sleep mode, in which the power source of the heating belt 8 is turned off, the rotation of the heating belt 8 is stopped, and the belt temperature becomes a low temperature (during the non-heating and the non-rotation of the heating belt 8), to the image formation, two next modes, that is, first and second modes, are set with respect to the control of a belt heating operation and a belt rotation operation of the heating belt 8. That is, the first mode is a combination mode of the heating of the heating roller 11 and the driving stop of the fixing roller 10 (that is, the rotation stop of the heating belt 8). The second mode is a combination mode of the heating mode of the heating roller 11 and the driving of the fixing roller 10 (that is, the rotation of the heating belt 8).

At the time of returning from the power source off state or the sleep mode, the control device of the image forming apparatus 1 first performs the heating control of the heating roller 11 and the driving control of the heating belt 8 using a driving unit by the first mode. That is, the heating roller 11 is heated and the driving of the heating belt 8 is stopped. Thereafter, the control device transitions from the first mode to the second mode and performs the control by the second mode. That is, the heating of the heating roller 11 is continuously performed and the heating belt 8 is driven. In this case, the control device performs the transition from the first mode to the second mode on the basis of the surface temperature of the heating belt 8 on a side thereof where it is stretched to the heating roller 11, which is detected by the second belt temperature detection devices 20.

At this time, the transition from the first mode to the second mode is executed when the temperature of the heating belt 8 reaches the mode transition reference temperature $T_{bs}$ (° C.) which is set in advance. The mode transition reference temperature $T_{bs}$ (° C.) is set to satisfy Equation 9 (that is, Equation 10) and Equation 11. This mode transition reference temperature $T_{bs}$ (° C.) is the temperature of the heating belt 8 in which the wrinkles of the heating belt 8 generated by the low temperature state of the belt due to the power source off state or the sleep mode disappear or substantially disappear.

$$L\times(T_b-T_r)\times\alpha_{hr}-L\times(T_b-T_r)\times\alpha_b \leqq L\times(T_{bs}-T_r)\times 2\times\alpha_{hr}-L\times(T_{bs}-T_r)\times\alpha_b \quad \text{Equation 9}$$

where,

L: Belt width (mm) of the heating belt and width (mm) between the guide rings of the heating roller, $T_b$: Temperature (° C.) of the heating belt during the rotation stop of the heating belt at the end of the previous image forming operation, $T_r$: Temperature (° C.) of the heating belt at the time of the start of the first mode, $T_{bs}$: Mode transition temperature (° C.) of the heating belt during the transition from the first mode to the second mode, $\alpha_{hr}$: Linear expansion coefficient (1/° C.) of the heating roller, and $\alpha_b$: Linear expansion coefficient (1/° C.) of the heating belt.

When Equation 9 is changed with respect to the mode transition reference temperature $T_{bs}$, $$\frac{(\alpha_{hr}-\alpha_b)T_b+\alpha_{hr}T_r}{2\alpha_{hr}-\alpha_b} \leqq T_{bs} \quad \text{Equation 10}$$

$$T_{bs} < T_0 \quad \text{Equation 11}$$

where, $T_0$: Destroy temperature (° C.) of the heating belt.

In Equations 9 and 10, the mode transition reference temperature $T_{bs}$ is determined on the basis of the temperature $T_b$ (° C.) of the heating belt 8 during the rotation stop of the heating belt 8 at the end of the previous image forming operation and the temperature $T_r$ (° C.) of the heating belt 8 at the time of the start of the first mode.

Figure 4A:
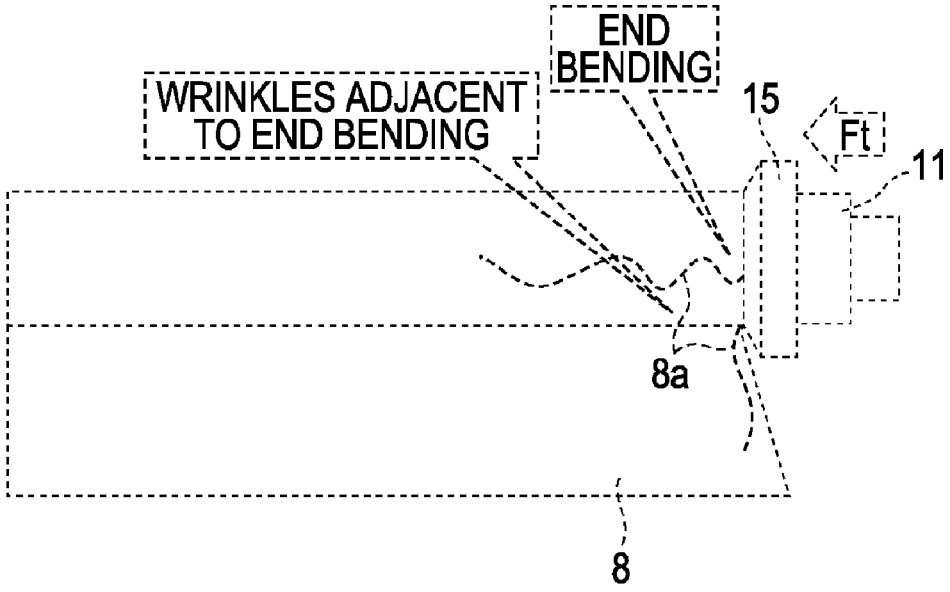
FIG. 4A is a view showing a heating belt state during non-heating and non-rotation.
Figure 4B:
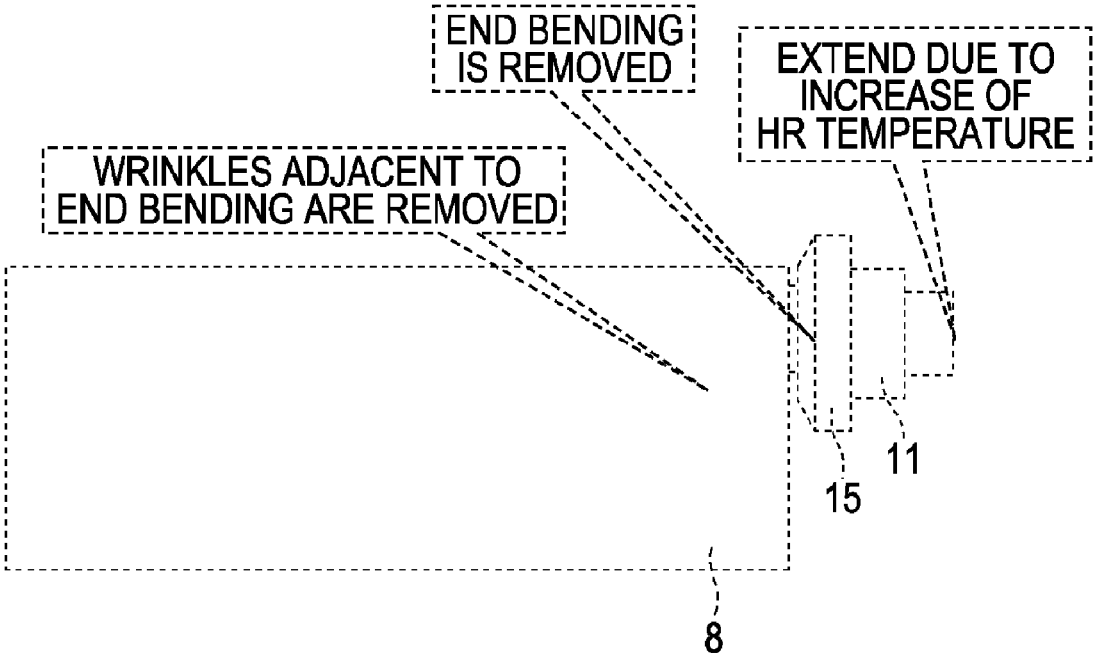
FIG. 4B is a view showing the heating belt state after heating in a first mode.

At the time of the power source off state or the sleep mode, in the low temperature state, since the contraction amount of the heating roller 11 in the axial direction is larger that of the heating belt 8 in the width direction as described above, wrinkles are generated in the heating belt 8 shown in FIG. 4A due to several concave portions 8*a*. At this time, the temperatures of the heating belt 8 and the heating roller 11 are substantially equal. In this state, when the fixing device 6 is returned to the power source off state or the sleep mode by an image forming command or the like, the heating roller 11 is heated. Accordingly, the heating belt 8 is heated by the first mode and the temperature thereof is increased. At this time, since the heating roller 11 is heated earlier than the heating belt 8, the temperature of the heating roller 11 becomes higher than the temperature of the heating belt 8 (that is, the temperature of the heating belt 8 detected by the second belt temperature detection devices 20) in the first mode. In this case, as the experiment results of the temperature measure, in the first mode, the temperature of the heating roller 11 becomes about twice of the temperature of the heating belt 8.

When the temperature of the heating belt 8 becomes the mode transition reference temperature $T_{bs}$, it is considered that the temperature of the heating roller 11 is about twice of the mode transition reference temperature $T_{bs}$. When the temperature of the heating belt 8 becomes the mode transition reference temperature $T_{bs}$, since the expansion amount of the heating roller 11 in the axial direction is large than that of the heating belt 8 in the width direction, the wrinkles in the heating belt 8 shown in FIG. 4B due to the concave portions 8*a* disappear. That is, the mode transition reference temperature $T_{bs}$ is set on the basis of the temperature $T_b$ (° C.) of the heating belt 8 during the rotation stop of the heating belt 8 at the end of the previous image forming operation and the temperature $T_r$ (° C.) of the heating belt 8 at the time of the start of the first mode, and is a temperature in which the wrinkles in the heating belt 8 due to the concave portions 8*a* disappear by the heating of the heating roller 11 in the first mode. In Equations 9 and 10, as the temperature $T_r$ of the heating belt, in lieu of the temperature at the time of the start of the first mode, an environment temperature (for example, a room temperature of 20° C. or the like) of a place where the image forming apparatus 1 is used may be used.

In Equation 11, the mode transition reference temperature $T_{bs}$ is set to lower than the belt destroy temperature $T_0$ (° C.). This belt destroy temperature $T_0$ (° C.) is given as a measured value. That is, By performing a belt heating destroy experiment in a temperature range including a temperature area derived using the heating belt 8, the fixing roller 10 and the heating roller 11 used in the fixing device 6, the belt destroy temperature $T_0$ (° C.) is set. As a detailed example, the fixing device 6 is solely set or the fixing device 6 is set in the image forming apparatus 1 in a state in which the temperature can be adjusted. The heating roller 11 is heated by the same control as the returning from the power source off state of the heater 13 or the sleep mode (power saving mode), without rotating the heating belt 8. In the vicinity of the boundary between a contact portion and a non-contact portion of the heating belt 8 and the heating roller 11 (in the vicinity of the contact start position β and a contact end position γ shown in FIG. 2), the temperature of the heating belt 8 when the start of the deformation of the heating belt 8 is visually confirmed is called the belt destroy temperature (heating destroy temperature) $T_0$ (° C.).

Figure 9:
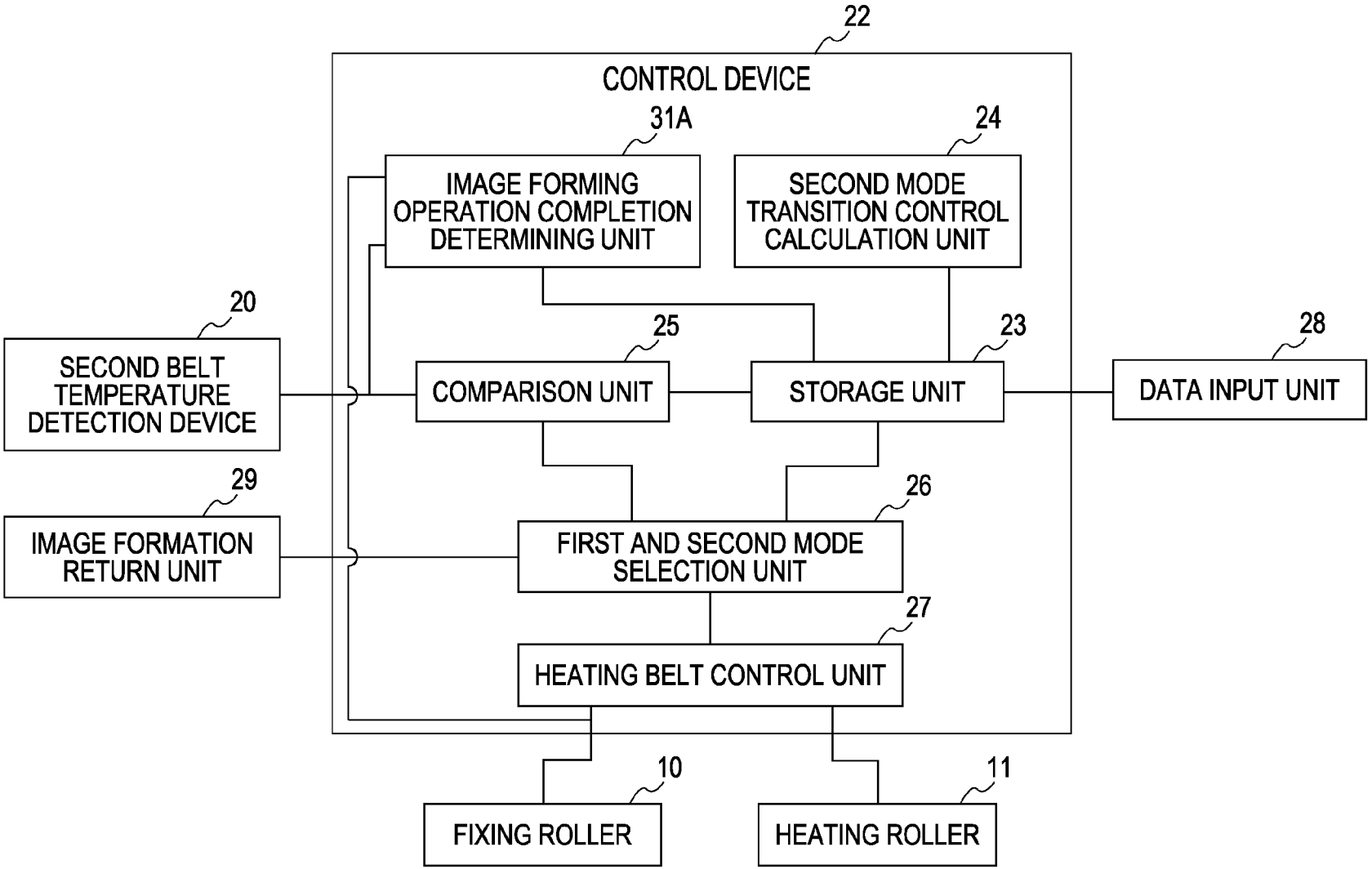
FIG. 9 is a block diagram showing an example of a third embodiment of a control device of the fixing device of the example shown in FIG. 2.

FIG. 9 is a block diagram of the control device for controlling the heating belt for image formation. As shown in FIG. 9, the control device 22 of the image forming apparatus 1 includes a storage unit 23, a second mode transition control calculation unit 24, a comparison unit 25, a first and second mode selection unit 26, a heating belt control unit 27, and an image forming operation completion determining unit 31A. The storage unit 23 is connected to a data input unit 28. When an operator such as a worker or a service man operates the data input unit 28, data is input to and stored in the storage unit 23. The data includes the width L (mm) of the heating belt 8 (the distance between the guide surfaces 15*a* of the guide rings 15 at both ends of the heating roller 11) in the fixing device 6 of the image forming apparatus 1, the temperature $T_b$ (° C.) of the heating belt 8 during the rotation stop of the heating belt 8 at the end of the image forming operation (substantially, the belt control temperature $T_b$ (° C.) of the heating belt 8 during the image forming operation), the temperature $T_r$ (° C.) of the heating belt 8 at the time of the start of the control of the heating belt 8 by the first mode, the mode transition reference temperature $T_{bs}$ (° C.) of the heating belt 8 during the transition from the first mode to the second mode, the destroy temperature $T_0$ (° C.) of the heating belt 8, the linear expansion coefficient $\alpha_{hr}$ (1/° C.) of the heating roller 11, and the linear expansion coefficient $\alpha_b$ (1/° C.) of the heating belt 8. In addition, the storage unit 23 stores the control contents of the heating belt 8 in the above-described first and second modes.

The second mode transition control calculation unit 24 calculates the temperature of the left side of Equation 10. The second mode transition control calculation unit 24 sets a calculated value or a value slightly larger than this value as the mode transition reference temperature $T_{bs}$ (° C.) of the fixing device 6 and stores the value in the storage unit 23.

The second belt temperature detection devices 20 are connected to the comparison unit 25. This comparison unit 25 compares the detected belt temperature (° C.) of the heating belt 8 detected by the second belt temperature detection devices 20 with the mode transition reference temperature $T_{bs}$ (° C.) during the transition to the second mode of the storage unit 23. The comparison unit 25 outputs a mode switching signal to the first and second mode selection unit 26 when it is determined that the detected belt temperature (° C.) becomes equal to or larger than the mode transition reference temperature $T_{bs}$ (° C.).

An image formation return unit 29 is connected to the first and second mode selection mode 26. This image formation return unit 29 is provided in an operating panel of the image forming apparatus 1 and is operated by, for example, a user, for image formation, so as to output a return signal for returning the image forming apparatus 1 from the power source off state or the sleep mode to the first and second mode selection unit 26. At this time, the heating belt 8 has the low temperature lower than the mode transition reference temperature $T_{bs}$ (° C.) by the power source off state or the sleep mode. Accordingly, the first and second mode selection unit 26 selects the first mode of the storage unit 23 by this return signal and outputs the control contents of the first mode to the heating belt control unit 27. Then, the heating belt control unit 27 heats the heating roller 11 (that is, the heating belt 8) and holds the driving of the heating belt 8 in a stop state, according to the control contents of the first mode.

When the image forming operation ends, the heating belt control unit 27 stops the rotation of the heating belt 8 and stops the heating of the heating roller 11. At this time, a rotation stop signal of the heating belt 8 from the heating belt control unit 27 is also supplied to the image forming operation completion determining unit 31A. In response to the input of the rotation stop signal, the image forming operation completion determining unit 31A stores the detected temperature $T_r$ (° C.) of the heating belt 8 supplied from the second belt temperature detection devices 20 in the storage unit 23. That is, the storage unit 23 stores therein the temperature $T_r$ (° C.) of the heating belt 8 at the end of the image forming operation (that is, during the rotation stop of the heating belt 8). Thus stored temperature $T_r$ (° C.) of the heating belt 8 is used in setting of the mode transition reference temperature $T_{bs}$ (° C.) during the subsequent image forming operation. That is, the stored temperature $T_r$ (° C.) of the heating belt 8 corresponds to the temperature $T_r$ (° C.) of the heating belt 8 at the end of the previous image forming operation according to the invention. Moreover, as described above, the mode transition reference temperature $T_{bs}$ (° C.) is set on the basis of a value obtained by the second mode transition control calculation unit 24 calculating the value using the higher temperature $T_r$ (° C.) of the temperatures $T_r$ (° C.) of the heating belt 8 at the end of the previous image forming operation, supplied from the two second belt temperature detection device 20.

By the heating of the heating belt 8 in the first mode, the belt temperature of the heating belt 11 is increased. The second belt temperature detection devices 20 detect the belt temperatures and output them to the comparison unit 25. Then, when it is determined that the higher one of the detected belt temperatures supplied from the second belt temperature detection devices 20 becomes equal to or larger than the mode transition reference temperature $T_{bs}$ (° C.) from the storage unit 23, the comparison unit 25 outputs a mode switching signal to the first and second mode selection unit 26. Then, the first and second mode selection unit 26 selects the second mode of the storage unit 23 by this mode switching signal and outputs the control contents of the second mode to the heating belt control unit 27. The heating belt control unit 27 continuously performs the heating of the heating roller 11 (that is, the heating belt 8), drives the fixing roller 10 by the driving unit, and rotates the heating belt 8, according to the control contents of the second mode. At this time, since the temperatures of the heating roller 11 and the heating belt 8 are the mode transition reference temperature $T_{bs}$ (° C.) satisfying Equations 10 and 11, the wrinkles generated in the heating belt 8 shown in FIG. 4A due to the concave portions 8*a* disappear as shown in FIG. 4B. Therefore, even when the heating belt 8 is rotated, the crack due to overlapping of the wrinkles is prevented, so that the heating belt 8 can be smoothly rotated.

By the continuous heating of the heating belt 8 in the second mode, the belt temperature of the heating belt 8 is increased. However, since the mode transition reference temperature $T_{bs}$ (° C.) is lower than the previously measured destroy temperature $T_0$ (° C.) in which the heating belt 8 is thermally destroyed, the heating belt 8 is not destroyed when the mode transitions to the second mode and the heating belt 8 is rotated.

According to the fixing device 6 of this example, at the time of the returning of the heating belt 8 for the image forming operation from the low belt temperature state of the heating belt 8 due to the OFF state of the power source of the heating roller 11 in the power source off state or the sleep mode (power saving mode), two modes are set with respect to the heating control and the rotation control of the heating belt 8. The first mode is a combination mode of the heating of the heating belt 8 and the rotation stop of the heating belt 8. The second mode is a combination mode of the heating of the heating belt 8 and the rotation of the heating belt 8. In this case, the mode transition reference temperature $T_{bs}$ (° C.) is set on the basis of the higher temperature of the heating belt 8 during the rotation stop of the heating belt 8 at the end of the previous image forming operation.

Accordingly, at the time of the returning of the heating belt 8, the heating belt 8 is first heated by the setting of the first mode, but the heating belt 8 is not rotated. Next, when the higher one of the surface temperatures of the heating belt 8 is increased to the mode transition reference temperature $T_{bs}$ (° C.), the heating of the heating belt 8 is continuously performed and the heating belt 8 is rotated, by the setting of the second mode. At this time, the winkles of the heating belt 8 disappear.

In such a case, the temperature of the heating belt 8 may change due to difference in the contents of the previous image forming operations. For example, in the image forming apparatus 1 in which a central position thereof in a direction perpendicular to a movement direction of the transfer material is set to a central position in the width direction of the heating belt 8, the temperature at both ends of the heating belt 8 and the heating roller 11 after continuous printing (continuous image formation) is performed on a transfer material of a small size smaller than a normal size becomes about 30° C. higher than that after the continuous printing of the same number of pages is performed on a transfer material of the normal size. This is because an area of the heating belt 8 through which the transfer material passes is deprived of heat by the transfer material but an area of the heating belt 8 through which the transfer material does not pass is not deprived of heat by the transfer material.

Moreover, after the continuously printing of a number of pages is performed on the transfer material of the normal size, the temperature of the heating belt 8 and the heating roller 11 increases temporarily due to an overshoot. As such, if the temperature of the heating belt 8 and the heating roller 11 during the rotation stop of the heating belt 8 is high, the temperature change becomes large when the temperature of the heating belt 8 and the heating roller 11 decreases to a normal temperature (e.g., a room temperature or the like) at the end of the image forming operation. Therefore, the amount of wrinkles occurred in the heating belt 8 increases. Further, if the temperature of the heating roller 11 at the end of the image forming operation is high, a difference from the mode transition reference temperature $T_{bs}$ (° C.) becomes relatively small. Therefore, there is a fear that the heating period in the first mode becomes short and that the second mode is set in a state in which the wrinkles of the heating belt 8 are not yet disappeared.

However, in the image forming apparatus 1 of this example, since the mode transition reference temperature $T_{bs}$ (° C.) is set on the basis of the temperature of the heating belt 8 during the rotation stop of the heating belt 8 at the end of the previous image forming operation, it is possible to increase the amount of heating of the heating belt 8 in a subsequent power source off state. Therefore, the heating belt 8 can be adequately heated. Accordingly, even when the temperature of the heating belt 8 is high at the time of the start of the control of the heating belt 8 by the first mode, the heating and the rotation of the heating belt 8 by the second mode can be performed after the wrinkles of the heating belt 8 are certainly disappeared.

Accordingly, the bias of the heating belt 8 entering the heating roller 11 can be suppressed by the guide ring 15. In addition, although the guide ring 15 presses the edge of the belt portion of the heating belt 8 in the width direction, since the wrinkles are not present in the heating belt 8, it is possible to certainly prevent the generation of the crack in the heating belt 8. Accordingly, it is possible to adequately perform the heating, the pressurization and fixing using the fixing device 6 over a long period of time.

In particular, since the temperature of the heating belt 8 at a position thereof where the temperature becomes the highest in the width direction thereof is used as the temperature of the heating belt 8, it is possible to effectively increase the amount of heating of the heating belt 8. Therefore, it is possible to prevent the generation of crack in the heating belt 8 in a more effective manner. According to the image forming apparatus 1 including the fixing device 6 of this example, since the heating, the pressurization and the fixing can be adequately performed, it is possible to form an image with high quality over a long period of time.

Next, a detailed example of the fixing device 6 of this example will be described.

The width of the heating belt 8 and the distance L (mm) between the guide rings 15 at both ends of the heating roller 11 are set to 310 mm. The belt control temperature $T_b$ (° C.) during the image forming operation is set to 155° C. That is, the temperature $T_b$ (° C.) of the heating belt 8 at the end of the previous image forming operation is 155° C. The temperature $T_r$ (° C.) of the heating belt 8 in the low-temperature state at the time of the start of the control of the heating belt 8 by the first mode is set to 20° C. The linear expansion coefficient $\alpha_{hr}$(1/° C.) of the heating roller 11 is set to 0.000024/° C. and the linear expansion coefficient $\alpha_b$ (1/° C.) of the heating belt 8 is set to 0.000015/° C. Therefore, the mode transition reference temperature $T_{bs}$ (° C.) of the heating belt 8 during the transition from the first mode to the second mode becomes to satisfy a relation of $T_{bs} \geqq 56.8°$ C. Therefore, in the case of this example, it may be desirable that the mode transition reference temperature $T_{bs}$ (° C.) is set to a temperature equal to or larger than 56.8° C. and lower than the measured destroy temperature $T_0$ (° C.).

Next, another example of the embodiment of the fixing device 6 according to the invention will be described.

In the fixing device 6 of the above-described embodiment, the transition from the first mode to the second mode is controlled on the basis of the mode transition reference temperature $T_{bs}$ (° C.). To the contrary, in the fixing device 6 of the embodiment of this example, the transition from the first mode to the second mode is controlled on the basis of the mode transition reference heating time $t_{bs}$ (sec) during which the heating belt 8 is heated.

That is, the mode transition reference heating time $t_{bs}$ (sec) of the heating belt 8 required for the transition from the first mode to the second mode is set to satisfy Equation 12. This mode transition reference heating time $t_{bs}$ (sec) is the heating time of the heating belt 8 in which the wrinkles of the heating belt 8 generated by the low temperature state of the belt due to the power source off state or the sleep mode disappear or substantially disappear. In calculation of the mode transition reference heating time $t_{bs}$ (sec), in addition to the mode transition reference temperature $T_{bs}$ (° C.), the calorific capacity $C_{hr}$ (KJ/K) of the heating belt 8 and the heating roller 11 and the heater wattage W (J/sec) of the heater 13 are used. The reason of using the mode transition reference heating time $t_{bs}$ (sec) is that the control of the heating belt 8 can be performed in a more accurate manner by taking the calorific capacity $C_{hr}$ (KJ/K) of the heating belt 8 and the heating roller 11 and the heater wattage W (J/sec) of the heater 13 into consideration.

$$t_{bs} \geqq C_{hr} \times T_{bs} \times (T_{bs} - T_r) \times 2/W \qquad \text{Equation 12}$$

where, $t_{bs}$: Mode transition reference heating time (sec) which is a heating time required for the start of the heating belt, $C_{hr}$: Calorific capacity (KJ/K) of the heating roller and the heating belt, W: Heater wattage (J/sec), and Other symbols are the same as those of Equation 5.

Figure 10:
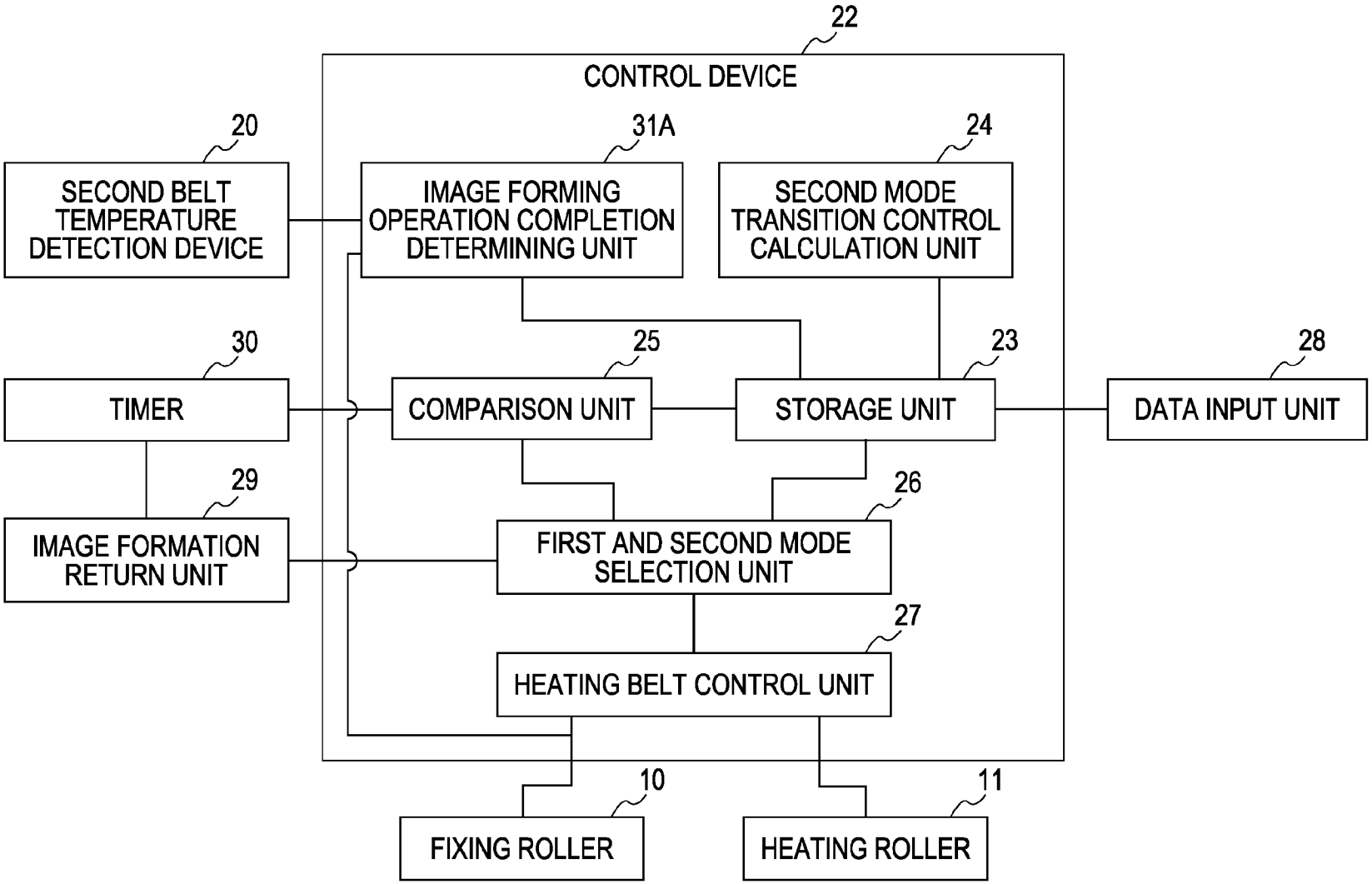
FIG. 10 is a block diagram showing another example of the third embodiment of the control device of the fixing device of the example shown in FIG. 2.

The control of the heating belt 8 using the mode transition reference heating time $t_{bs}$ (sec) is performed by the control device 22 shown in FIG. 10. In this case, the control device 22 is provided with a timer 30. The timer 30 is supplied with an operation signal from the image formation return unit 29 during the above-described returning. Then, the timer 30 starts measuring a period of time in response to the input of the operation signal and outputs the measured period of time to the comparison unit 25. Moreover, similar to the above-described example, the operation signal of the image formation return unit 29 is input to the first and second mode selection unit 26 as the switching signal. Therefore, similar to the above-described example, the control of the heating belt 8 by the first mode is started.

The storage unit 23 of the control device 22 has stored therein the calorific capacity $C_{hr}$ (KJ/K) of the heating belt 8 and the heating roller 11 and the heater wattage W (J/sec) of the heater 13. The second mode transition control calculation unit 24 calculates the mode transition reference temperature $T_{bs}$ (° C.) on the basis of Equation 2 and calculates the time of the right side of Equation 12. Further, the calculated time of the right side of Equation 12 or a period of time slightly longer than the calculated time is set as the mode transition reference heating time $t_{bs}$ (sec) and stored in the storage unit 23. When the time measured by the timer 30 from the start of the control of the heating belt 8 by the first mode reaches the mode transition reference heating time $t_{bs}$ (sec), the comparison unit 25 outputs the switching signal to the first and second mode selection unit 26. Thereafter, similar to the above-described example, the heating belt 8 is controlled by the second mode.

Further, in the control of the heating belt 8 using the mode transition reference heating time $t_{bs}$ (sec), the belt destroy temperature $T_0$ (° C.) of the above-described example is used. Other configurations and other operations of the fixing device 6, the control device 22 and the image forming apparatus 1 of this example are the same as those of the above-described example.

When an environment temperature (for example, a room temperature of 20° C. or the like) of a place where the image forming apparatus 1 is used is used as the temperature $T_r$ of the heating belt in Equations 9 and 10, the image forming operation completion determining unit 31A shown in FIGS. 9 and 10 is not required. In such a case, the environment temperature (for example, a room temperature of 20° C. or the like) may be input, for example, by the data input unit 28 to be stored in the storage unit 23.

Fourth Embodiment

Hereinafter, a fourth embodiment of the invention will be described with reference to the accompanying drawings. The same constituent elements as those of the first to third embodiments will be referenced by the same reference numerals. Since the fixing device of the fourth embodiment has the same configuration as the fixing devices of the first to third embodiments, except that their control-related configurations are different, the description of the same configuration will be omitted.

First belt temperature detecting devices (for example, a thermistor or the like) 19 are provided in a state of being in contact with or in the vicinity of the heating belt 8 stretched over the heating roller 11. These first belt temperature detecting devices 19 detect the surface temperature of a portion of the heating belt 8 and send the surface temperature to a control device (not shown) of the image forming apparatus. The control device controls the ON/OFF of the heater 13 on the basis of the temperature of the heating belt 8 detected by the first belt temperature detecting devices 19 such that the temperature of the heating belt 8 is held at a desired temperature during an image forming operation. Transition from a first mode to a second mode is controlled on the basis of the temperature of the heating belt 8 detected by the first belt temperature detecting devices 19.

Second belt temperature detection devices (for example, a thermistor or the like) 20 are provided in a state of being in contact with or in the vicinity of the heating belt 8 anterior to a contact start position β which is in contact with the heating roller 11. In this case, although not shown, the second belt temperature detection devices 20 are arranged at two places. That is, the second belt temperature detection devices 20 are arranged at positions corresponding to a central portion of the heating belt 8 in a width direction and any one end of both ends of the heating belt 8 in the width direction. These second belt temperature detection devices 20 detect the surface temperature of the heating belt 8 immediately before being brought into contact with the heating roller 11 and send the surface temperature to the control device of the image forming apparatus 1. The control device calculates a mode transition reference temperature $T_{bs}$ (° C.) on the basis of a higher temperature of the temperatures of the heating belt 8 detected by the two second belt temperature detection devices 20. In addition, as the temperature of the heating belt 8, the temperature of the portion of the heating belt 8 wound on the heating roller 11, which is detected by the first belt temperature detection devices 19, as well as the temperatures detected by the second belt temperature detection devices 20 may be used. In this case, the two first belt temperature detection devices 19 are arranged on the central portion of the heating belt 8 and any one end of both ends of the heating belt 8 in the width direction, as described above. The first belt temperature detection devices 19 and the second belt temperature detection devices 20 may be arranged at positions which become the same phase with respect to the rotation direction of the heating belt 8. In this case, the first belt temperature detection devices 19 are arranged on the central portion of the heating belt 8 in the width direction, and the second belt temperature detection devices 20 are arranged on any one end of both ends of the heating belt 8 in the width direction.

A third belt temperature detection device (for example, a thermostat or the like) 21 is arranged on the side of the first belt temperature detection devices 19 rather than the second belt temperature detection devices 20 toward the rotation direction α of the heating belt 8. This third belt temperature detection device 21 is provided in the vicinity of the heating belt 8 so as to detect the surface temperature of the heating belt 8. The third belt temperature detection device 21 turns off the power source of the heater 13 when the temperature of the heating belt 8 (that is, the temperatures of the heating roller 11 and the heater 13) becomes abnormally a high temperature by an unexpected situation. Accordingly, it is possible to prevent the adverse effect due to the abnormal increase of the temperature of the heating belt 8 (that is, the temperatures of the heating roller 11 and the heater 13) (high-temperature destroy or the like of the heating roller 11 or the heating belt 8).

In the fixing device 6 of this example, at the time of returning from a power source off state or a sleep mode, in which the power source of the heating belt 8 is turned off, the rotation of the heating belt 8 is stopped, and the belt temperature becomes a low temperature (during the non-heating and the non-rotation of the heating belt 8), to the image formation, two next modes, that is, first and second modes, are set with respect to the control of a belt heating operation and a belt rotation operation of the heating belt 8. That is, the first mode is a combination mode of the heating of the heating roller 11 and the driving stop of the fixing roller 10 (that is, the rotation stop of the heating belt 8). The second mode is a combination mode of the heating mode of the heating roller 11 and the driving of the fixing roller 10 (that is, the rotation of the heating belt 8).

At the time of returning from the power source off state or the sleep mode, the control device of the image forming apparatus 1 first performs the heating control of the heating roller 11 and the driving control of the heating belt 8 using a driving unit by the first mode. That is, the heating roller 11 is heated and the driving of the heating belt 8 is stopped. Thereafter, the control device transitions from the first mode to the second mode and performs the control by the second mode. That is, the heating of the heating roller 11 is continuously performed and the heating belt 8 is driven. In this case, the control device performs the transition from the first mode to the second mode on the basis of the surface temperature of the heating belt 8 on a side thereof where it is stretched to the heating roller 11, which is detected by the second belt temperature detection devices 20.

At this time, the transition from the first mode to the second mode is executed when the temperature of the heating belt 8 reaches the mode transition reference temperature $T_{bs}$ (° C.) which is set in advance. The mode transition reference temperature $T_{bs}$ (° C.) is set to satisfy Equation 13 (that is, Equation 14) and Equation 15. This mode transition reference temperature $T_b$, (° C.) is the temperature of the heating belt 8 in which the wrinkles of the heating belt 8 generated by the low temperature state of the belt due to the power source off state or the sleep mode disappear or substantially disappear.

$$L\times(T_{bJOB}-T_r)\times\alpha_{hr}-L\times(T_{bJOB}-T_r)\times\alpha_b \leqq L\times(T_{bs}-T_r)\times 2\times\alpha_{hr}-L\times(T_{bs}-T_r)\times\alpha_b \quad \text{Equation 13}$$

where,

L: Belt width (mm) of the heating belt and width (mm) between the guide rings of the heating roller, $T_{bJOB}$: Predicted temperature (° C.) of the heating belt which is set by adding a predetermined temperature to the temperature of the heating belt during the rotation stop of the heating belt at the end of the previous image forming operation on the basis of the transfer material size and the number of image forming pages during the previous image forming operation, $T_r$: Temperature (° C.) of the heating belt at the time of the start of the first mode, $T_{bs}$: Mode transition temperature (° C.) of the heating belt during the transition from the first mode to the second mode, $\alpha_{hr}$: Linear expansion coefficient (1/° C.) of the heating roller, and $\alpha_b$: Linear expansion coefficient (1/° C.) of the heating belt.

When Equation 13 is changed with respect to the mode transition reference temperature $T_{bs}$, $$\frac{(\alpha_{hr}-\alpha_b)T_{bJOB}+\alpha_{hr}T_r}{2\alpha_{hr}-\alpha_b} \leqq T_{bs} \quad \text{Equation 14}$$

$$T_{bs} < T_0 \quad \text{Equation 15}$$

where, $T_0$: Destroy temperature (° C.) of the heating belt.

In Equation 13, the mode transition reference temperature $T_{bs}$ is determined on the basis of a predicted temperature $T_{bJOB}$(° C.) of the heating belt 8, which is set on the basis of the size of the transfer material during the previous image forming operation and the number of continuous image forming pages, and the temperature $T_b$ (° C.) of the heating belt 8 at the time of the start of the first mode. The predicted temperature $T_{bJOB}$(° C.) of the heating belt 8 is set to a temperature obtained by adding a predetermined temperature to the temperature $T_r$ (° C.) of the heating belt 8 during the rotation stop of the heating belt 8 at the end of the previous image forming operation, on the basis of the above-described transfer material size and the number of continuous image forming pages. The temperature $T_b$ (° C.) of the heating belt 8 is the higher one of the temperatures measured by the second belt temperature detection devices 20 shown in FIGS. 12 and 13, which will be described later.

Figure 11:
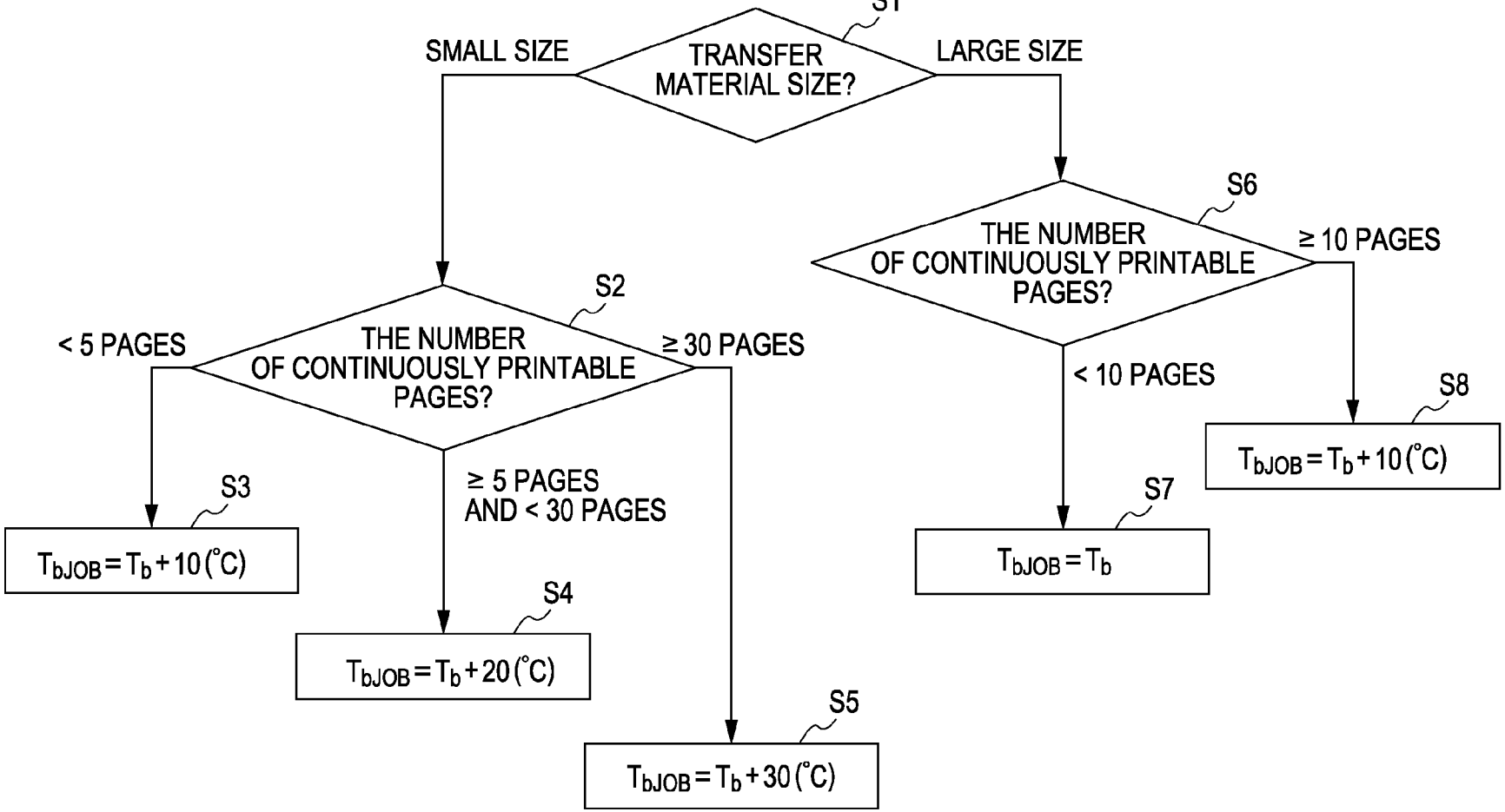
FIG. 11 is a diagram showing the flow of determining a predetermined temperature which is added on the basis of a transfer material size and the number of continuous image forming pages.

FIG. 11 is a diagram showing the flow of determining a predetermined temperature which is added on the basis of a transfer material size and the number of continuous image forming pages. As shown in FIG. 11, in step S1, it is determined whether the transfer material size during the previous image forming operation corresponds to a small size or a large size. That is, it is determined whether the size of the transfer material during the previous image forming operation in the same direction as the width direction of the heating belt 8 is smaller (i.e., small size) than a normal size (e.g., the size of A4 at the time of longitudinal transport thereof) with respect to the width of the heating belt 8 or equal to or larger than the normal size (i.e., large size).

When it is determined to be smaller than the normal size, the number of continuously printable pages (number of continuous image forming pages) is determined in step S2. When the number of continuously printable pages is determined to be smaller than 5 pages, the predicted temperature $T_{bJOB}$(° C.) of the heating belt 8 is set, in step S3, to a temperature obtained by adding a temperature of 10° C. to the temperature $T_b$ (° C.) of the heating belt 8 during the rotation stop of the heating belt 8 at the end of the previous image forming operation. On the other hand, when the number of continuously printable pages is determined in step S2 to be equal to or larger than 5 pages but smaller than 30 pages, the predicted temperature $T_{bJOB}$(° C.) of the heating belt 8 is set, in step S4, to a temperature obtained by adding a temperature of 20° C. to the temperature $T_b$ (° C.) of the heating belt 8. Further, when the number of continuously printable pages is determined in step S2 to equal to or larger than 30 pages, the predicted temperature $T_{bJOB}$(° C.) of the heating belt 8 is set, in step S5, to a temperature obtained by adding a temperature of 30° C. to the temperature $T_b$ (° C.) of the heating belt 8.

When the transfer material size during the previous image forming operation is determined in step S1 to be equal to or larger than the normal size, the number of continuously printable pages (number of continuous image forming pages) is determined in step S6. When the number of continuously printable pages is determined to be smaller than 10 pages, the predicted temperature $T_{bJOB}$(° C.) of the heating belt 8 is set to the temperature $T_b$ (° C.) of the heating belt 8 in step S7. That is, in this case, no additional temperature is added to the temperature $T_b$ (° C.) of the heating belt 8. Moreover, when the number of continuously printable pages is determined in step S6 to be equal to or larger than 10 pages, the predicted temperature $T_{bJOB}$(° C.) of the heating belt 8 is set to a temperature obtained by adding a temperature of 10° C. to the temperature $T_b$ (° C.) of the heating belt 8 in step S8.

In this way, when the transfer material size during the previous image forming operation corresponds to the small size, the predicted temperature $T_{bJOB}$(° C.) of the heating belt 8 is set to be higher than that when the transfer material size corresponds to the large size. Moreover, when the number of image forming pages is large, the predicted temperature $T_{bJOB}$(° C.) of the heating belt 8 is set to be higher than that when the number of image forming pages is small. In such a case, in the image forming apparatus 1 equipped with the fixing device 6 of this example, when printing is performed with a normally used transfer material size (e.g., the size of A4 at the time of longitudinal transport thereof) for a normal number of continuously printable pages (e.g., less than 10 pages), the predicted temperature $T_{bJOB}$(° C.) of the heating belt 8 is set to the temperature $T_b$ (° C.) of the heating belt 8.

That is, at the time of the power source off state or the sleep mode, in the low temperature state, since the contraction amount of the heating roller 11 in the axial direction is larger that of the heating belt 8 in the width direction as described above, wrinkles are generated in the heating belt 8 shown in FIG. 4A due to several concave portions 8*a*. At this time, the temperatures of the heating belt 8 and the heating roller 11 are substantially equal. In this state, when the fixing device 6 is returned to the power source off state or the sleep mode by an image forming command or the like, the heating roller 11 is heated. Accordingly, the heating belt 8 is heated by the first mode and the temperature thereof is increased. At this time, since the heating roller 11 is heated earlier than the heating belt 8, the temperature of the heating roller 11 becomes higher than the temperature of the heating belt 8 (that is, the temperature of the heating belt 8 detected by the second belt temperature detection devices 20) in the first mode. In this case, as the experiment results of the temperature measure, in the first mode, the temperature of the heating roller 11 becomes about twice of the temperature of the heating belt 8.

When the temperature of the heating belt 8 becomes the mode transition reference temperature $T_{bs}$, it is considered that the temperature of the heating roller 11 is about twice of the mode transition reference temperature $T_{bs}$. When the temperature of the heating belt 8 becomes the mode transition reference temperature $T_{bs}$, since the expansion amount of the heating roller 11 in the axial direction is large than that of the heating belt 8 in the width direction, the wrinkles in the heating belt 8 shown in FIG. 4B due to the concave portions 8*a* disappear.

As such, the mode transition reference temperature $T_{bs}$ (° C.) is the temperature of the heating belt 8 in which the wrinkles occurred in the heating belt 8 disappear during the transition from the first mode to the second mode. In Equations 13 and 14, as the temperature $T_r$ of the heating belt, in lieu of the temperature at the time of the start of the first mode, an environment temperature (for example, a room temperature of 20° C. or the like) of a place where the image forming apparatus 1 is used may be used.

In Equation 15, the mode transition reference temperature $T_{bs}$ is set to lower than the belt destroy temperature $T_0$ (° C.). This belt destroy temperature $T_0$ (° C.) is given as a measured value. That is, By performing a belt heating destroy experiment in a temperature range including a temperature area derived using the heating belt 8, the fixing roller 10 and the heating roller 11 used in the fixing device 6, the belt destroy temperature $T_0$ (° C.) is set. As a detailed example, the fixing device 6 is solely set or the fixing device 6 is set in the image forming apparatus 1 in a state in which the temperature can be adjusted. The heating roller 11 is heated by the same control as the returning from the power source off state of the heater 13 or the sleep mode (power saving mode), without rotating the heating belt 8. In the vicinity of the boundary between a contact portion and a non-contact portion of the heating belt 8 and the heating roller 11 (in the vicinity of the contact start position β and a contact end position γ shown in FIG. 2), the temperature of the heating belt 8 when the start of the deformation of the heating belt 8 is visually confirmed is called the belt destroy temperature (heating destroy temperature) $T_0$ (° C.).

Figure 12:
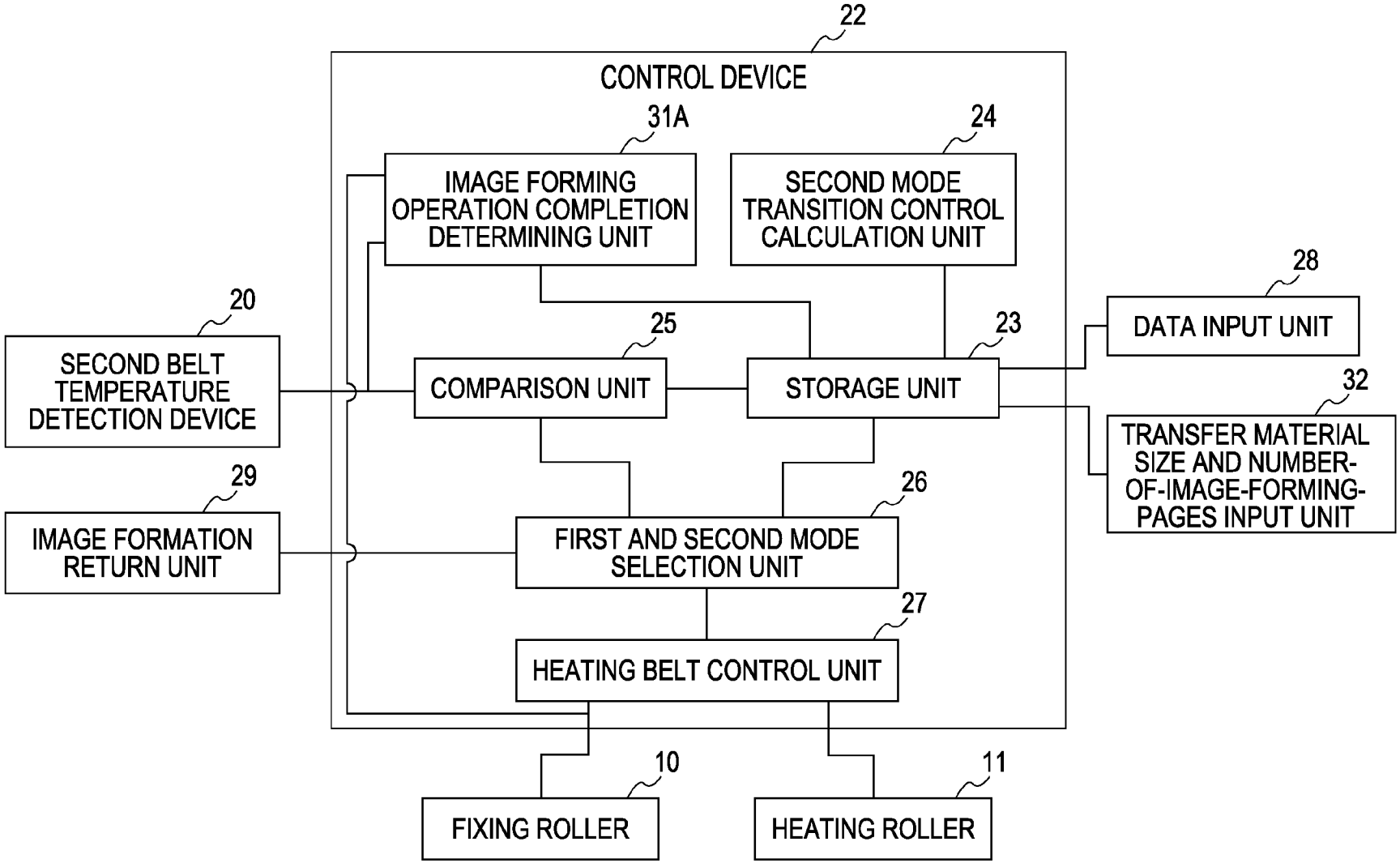
FIG. 12 is a block diagram showing an example of a fourth embodiment of a control device of the fixing device of the example shown in FIG. 2.

FIG. 12 is a block diagram of the control device for controlling the heating belt for image formation. As shown in FIG. 12, the control device 22 of the image forming apparatus 1 includes a storage unit 23, a second mode transition control calculation unit 24, a comparison unit 25, a first and second mode selection unit 26, a heating belt control unit 27, an image forming operation completion determining unit 31A, and a number-of-image-forming-pages input unit 32.

The storage unit 23 is connected to a data input unit 28 and the transfer material size and number-of-image-forming-pages input unit 32. When an operator such as a worker or a service man operates the data input unit 28, data is input to and stored in the storage unit 23. The data includes the width L (mm) of the heating belt 8 (the distance between the guide surfaces 15*a* of the guide rings 15 at both ends of the heating roller 11) in the fixing device 6 of the image forming apparatus 1, the temperature $T_b$ (° C.) of the heating belt 8 during the rotation stop of the heating belt 8 at the end of the previous image forming operation (substantially, the belt control temperature $T_b$ (° C.) of the heating belt 8 during the image forming operation), the temperature $T_r$ (° C.) of the heating belt 8 at the time of the start of the control of the heating belt 8 by the first mode, the mode transition reference temperature $T_{bs}$ (° C.) of the heating belt 8 during the transition from the first mode to the second mode, the destroy temperature $T_0$ (° C.) of the heating belt 8, the linear expansion coefficient $\alpha_{hr}$ (1/° C.) of the heating roller 11, and the linear expansion coefficient $\alpha_b$ (1/° C.) of the heating belt 8. Moreover, the size of the transfer material to be used and the number of image forming pages are input to and stored in the storage unit 23 when an operator such as a user operates the transfer material size and number-of-image-forming-pages input unit 32 for image formation. In addition, the storage unit 23 stores the control contents of the heating belt 8 in the above-described first and second modes.

The second mode transition control calculation unit 24 calculates the temperature of the left side of Equation 14. The second mode transition control calculation unit 24 sets a calculated value or a value slightly larger than this value as the mode transition reference temperature $T_{bs}$ (° C.) of the fixing device 6 and stores the value in the storage unit 23.

The second belt temperature detection devices 20 are connected to the comparison unit 25. This comparison unit 25 compares the detected belt temperature (° C.) of the heating belt 8 detected by the second belt temperature detection devices 20 with the mode transition reference temperature $T_{bs}$ (° C.) during the transition to the second mode of the storage unit 23. The comparison unit 25 outputs a mode switching signal to the first and second mode selection unit 26 when it is determined that the detected belt temperature (° C.) becomes equal to or larger than the mode transition reference temperature $T_{bs}$ (° C.).

An image formation return unit 29 is connected to the first and second mode selection mode 26. This image formation return unit 29 is provided in an operating panel of the image forming apparatus 1 and is operated by, for example, a user, for image formation, so as to output a return signal for returning the image forming apparatus 1 from the power source off state or the sleep mode to the first and second mode selection unit 26. At this time, the heating belt 8 has the low temperature lower than the mode transition reference temperature $T_{bs}$ (° C.) by the power source off state or the sleep mode. Accordingly, the first and second mode selection unit 26 selects the first mode of the storage unit 23 by this return signal and outputs the control contents of the first mode to the heating belt control unit 27. Then, the heating belt control unit 27 heats the heating roller 11 (that is, the heating belt 8) and holds the driving of the heating belt 8 in a stop state, according to the control contents of the first mode.

When the image forming operation ends, the heating belt control unit 27 stops the rotation of the heating belt 8 and stops the heating of the heating roller 11. At this time, a rotation stop signal of the heating belt 8 from the heating belt control unit 27 is also supplied to the image forming operation completion determining unit 31A. In response to the input of the rotation stop signal, the image forming operation completion determining unit 31A stores the detected temperature $T_r$ (° C.) of the heating belt 8 supplied from the second belt temperature detection devices 20 in the storage unit 23. That is, the storage unit 23 stores therein the temperature $T_r$ (° C.) of the heating belt 8 at the end of the image forming operation (that is, during the rotation stop of the heating belt 8). Thus stored temperature $T_r$ (° C.) of the heating belt 8 is used in setting of the mode transition reference temperature $T_{bs}$ (° C.) during the subsequent image forming operation. That is, the stored temperature $T_r$ (° C.) of the heating belt 8 corresponds to the temperature $T_r$ (° C.) of the heating belt 8 at the end of the previous image forming operation according to the invention. Moreover, as described above, the mode transition reference temperature $T_{bs}$ (° C.) is set on the basis of a value obtained by the second mode transition control calculation unit 24 calculating the value using the higher temperature $T_r$ (° C.) of the temperatures $T_r$ (° C.) of the heating belt 8 at the end of the image forming operation, supplied from the two second belt temperature detection device 20.

By the heating of the heating belt 8 in the first mode, the belt temperature of the heating belt 11 is increased. The second belt temperature detection devices 20 detect the belt temperatures and output them to the comparison unit 25. Then, when it is determined that the higher one of the detected belt temperatures supplied from the second belt temperature detection devices 20 becomes equal to or larger than the mode transition reference temperature $T_{bs}$ (° C.) from the storage unit 23, the comparison unit 25 outputs a mode switching signal to the first and second mode selection unit 26. Then, the first and second mode selection unit 26 selects the second mode of the storage unit 23 by this mode switching signal and outputs the control contents of the second mode to the heating belt control unit 27. The heating belt control unit 27 continuously performs the heating of the heating roller 11 (that is, the heating belt 8), drives the fixing roller 10 by the driving unit, and rotates the heating belt 8, according to the control contents of the second mode. At this time, since the temperatures of the heating roller 11 and the heating belt 8 are the mode transition reference temperature $T_{bs}$ (° C.) satisfying Equations 14 and 15, the wrinkles generated in the heating belt 8 shown in FIG. 4A due to the concave portions 8*a* disappear as shown in FIG. 4B. Therefore, even when the heating belt 8 is rotated, the crack due to overlapping of the wrinkles is prevented, so that the heating belt 8 can be smoothly rotated.

By the continuous heating of the heating belt 8 in the second mode, the belt temperature of the heating belt 8 is increased. However, since the mode transition reference temperature $T_{bs}$ (° C.) is lower than the previously measured destroy temperature $T_0$ (° C.) in which the heating belt 8 is thermally destroyed, the heating belt 8 is not destroyed when the mode transitions to the second mode and the heating belt 8 is rotated.

According to the fixing device 6 of this example, at the time of the returning of the heating belt 8 for the image forming operation from the low belt temperature state of the heating belt 8 due to the OFF state of the power source of the heating roller 11 in the power source off state or the sleep mode (power saving mode), two modes are set with respect to the heating control and the rotation control of the heating belt 8. The first mode is a combination mode of the heating of the heating belt 8 and the rotation stop of the heating belt 8. The second mode is a combination mode of the heating of the heating belt 8 and the rotation of the heating belt 8. In this case, the mode transition reference temperature $T_{bs}$ (° C.) is set on the basis of the higher temperature of the heating belt 8 during the rotation stop of the heating belt 8 at the end of the previous image forming operation.

Accordingly, at the time of the returning of the heating belt 8, the heating belt 8 is first heated by the setting of the first mode, but the heating belt 8 is not rotated. Next, when the higher one of the surface temperatures of the heating belt 8 is increased to the mode transition reference temperature $T_{bs}$ (° C.), the heating of the heating belt 8 is continuously performed and the heating belt 8 is rotated, by the setting of the second mode. At this time, the winkles of the heating belt 8 disappear.

In such a case, the temperature of the heating belt 8 may change due to difference in the contents of the previous image forming operations. For example, in the image forming apparatus 1 in which a central position thereof in a direction perpendicular to a movement direction of the transfer material is set to a central position in the width direction of the heating belt 8, the temperature at both ends of the heating belt 8 and the heating roller 11 after continuous printing (continuous image formation) is performed on a transfer material of a small size smaller than a normal size becomes about 30° C. higher than that after the continuous printing of the same number of pages is performed on a transfer material of the normal size. This is because an area of the heating belt 8 through which the transfer material passes is deprived of heat by the transfer material but an area of the heating belt 8 through which the transfer material does not pass is not deprived of heat by the transfer material.

Moreover, after the continuously printing of a number of pages is performed on the transfer material of the normal size, the temperature of the heating belt 8 and the heating roller 11 increases temporarily due to an overshoot. As such, if the temperature of the heating belt 8 and the heating roller 11 during the rotation stop of the heating belt 8 is high, the temperature change becomes large when the temperature of the heating belt 8 and the heating roller 11 decreases to a normal temperature (e.g., a room temperature or the like) at the end of the image forming operation. Therefore, the amount of wrinkles occurred in the heating belt 8 increases. Further, if the temperature of the heating roller 11 at the end of the image forming operation is high and if the image forming apparatus returns to the image forming operation during a time when the temperature of the heating roller 11 is not decreases much, a difference from the mode transition reference temperature $T_{bs}$ (° C.) becomes relatively small. Therefore, there is a fear that the heating period in the first mode becomes short and that the second mode is set in a state in which the wrinkles of the heating belt 8 are not yet disappeared.

However, in the image forming apparatus 1 of this example, the mode transition reference temperature $T_{bs}$ (° C.) is set on the basis of at least one of the size of the transfer material during the previous image forming operation and the number of image forming pages. Therefore, it is possible to control the amount of heating of the heating belt 8 in a subsequent power source off state or sleep mode in accordance with the amount of wrinkles occurred in the heating belt 8.

In this case, when the size of the transfer material during the previous image forming operation in the same direction as the width direction of the heating belt 8 is smaller than the normal size (e.g., the size of A4 at the time of longitudinal transport thereof) with respect to the width of the heating belt 8, the mode transition reference temperature $T_{bs}$ (° C.) is set to be higher. On the other hand, when the size of the transfer material during the previous image forming operation in the same direction as the width direction of the heating belt 8 is equal to or larger than the normal size with respect to the width of the heating belt 8, the mode transition reference temperature $T_{bs}$ (° C.) is set to be lower than that when it is smaller than the normal size.

Moreover, when the number of continuous image forming pages during the previous image forming operation is larger than the normal number of pages (e.g., 5 pages or more), the mode transition reference temperature $T_{bs}$ (° C.) is set to be higher. On the other hand, when the number of continuous image forming pages during the previous image forming operation is smaller than the normal number of pages, the mode transition reference temperature $T_{bs}$ (° C.) is set to be lower than that when it is larger than the normal number of pages.

Therefore, in the first mode, the heating belt 8 can be appropriately heated in accordance with the fixing states (that is, the size of the transfer material during the previous image forming operation and the number of continuous image forming pages) during the previous image forming operation on the basis of the mode transition reference temperature $T_{bs}$ (° C.). Accordingly, the heating and the rotation of the heating belt 8 by the second mode can be performed after the wrinkles of the heating belt 8 are certainly disappeared in the first mode.

Accordingly, the bias of the heating belt 8 entering the heating roller 11 can be suppressed by the guide ring 15. In addition, although the guide ring 15 presses the edge of the belt portion of the heating belt 8 in the width direction, since the wrinkles are not present in the heating belt 8, it is possible to prevent the generation of the crack in the heating belt 8. Accordingly, it is possible to adequately perform the heating, the pressurization and fixing using the fixing device 6 over a long period of time.

In particular, since the temperature of the heating belt 8 at a position thereof where the temperature becomes the highest in the width direction thereof is used as the temperature of the heating belt 8, it is possible to effectively increase the amount of heating of the heating belt 8. Therefore, it is possible to prevent the generation of crack in the heating belt 8 in a more effective manner. According to the image forming apparatus 1 including the fixing device 6 of this example, since the heating, the pressurization, and the fixing can be adequately performed, it is possible to form an image with high quality over a long period of time.

Next, a detailed example of the fixing device 6 of this example will be described.

The width of the heating belt 8 and the distance L (mm) between the guide rings 15 at both ends of the heating roller 11 are set to 310 mm. The belt control temperature $T_b$ (° C.) during the image forming operation is set to 155° C. That is, the temperature $T_b$ (° C.) of the heating belt 8 at the end of the previous image forming operation is 155° C. Moreover, continuous image formation of 10 pages is performed on a transfer material having the A4 size in the longitudinal transport thereof. That is, the predicted temperature $T_{bJOB}$(° C.) of the heating belt 8 is 165° C. The temperature $T_r$ (° C.) of the heating belt 8 in the low-temperature state at the time of the start of the control of the heating belt 8 by the first mode is set to 20° C. The linear expansion coefficient $\alpha_{hr}$ (1/° C.) of the heating roller 11 is set to 0.000024/° C. and the linear expansion coefficient $\alpha_b$ (1/° C.) of the heating belt 8 is set to 0.000015/° C. Therefore, the mode transition reference temperature $T_{bs}$ (° C.) of the heating belt 8 during the transition from the first mode to the second mode becomes to satisfy a relation of $T_{bs} \geqq 55.5°$ C. Therefore, in the case of this example, it may be desirable that the mode transition reference temperature $T_{bs}$ (° C.) is set to a temperature equal to or larger than 59.5° C. and lower than the measured destroy temperature $T_0$ (° C.).

Next, another example of the embodiment of the fixing device 6 according to the invention will be described.

In the fixing device 6 of the above-described embodiment, the transition from the first mode to the second mode is controlled on the basis of the mode transition reference temperature $T_{bs}$ (° C.). To the contrary, in the fixing device 6 of the embodiment of this example, the transition from the first mode to the second mode is controlled on the basis of the mode transition reference heating time $t_{bs}$ (sec) during which the heating belt 8 is heated.

That is, the mode transition reference heating time $t_{bs}$ (sec) of the heating belt 8 required for the transition from the first mode to the second mode is set to satisfy Equation 16. This mode transition reference heating time $t_{bs}$ (sec) is the heating time of the heating belt 8 in which the wrinkles of the heating belt 8 generated by the low temperature state of the belt due to the power source off state or the sleep mode disappear or substantially disappear. In calculation of the mode transition reference heating time $t_{bs}$ (sec), in addition to the mode transition reference temperature $T_{bs}$ (° C.), the calorific capacity $C_{hr}$ (KJ/K) of the heating belt 8 and the heating roller 11 and the heater wattage W (J/sec) of the heater 13 are used. The reason of using the mode transition reference heating time $t_{bs}$ (sec) is that the control of the heating belt 8 can be performed in a more accurate manner by taking the calorific capacity $C_{hr}$ (KJ/K) of the heating belt 8 and the heating roller 11 and the heater wattage W (J/sec) of the heater 13 into consideration.

$$t_{bs} \geqq C_{hr} \times T_{bs} \times (T_{bs} - T_r) \times 2/W \qquad \text{Equation 16}$$

where, $t_{bs}$: Mode transition reference heating time (sec) which is a heating time required for the start of the heating belt, $C_{hr}$: Calorific capacity (KJ/K) of the heating roller and the heating belt, W: Heater wattage (J/sec), and Other symbols are the same as those of Equation 5.

Figure 13:
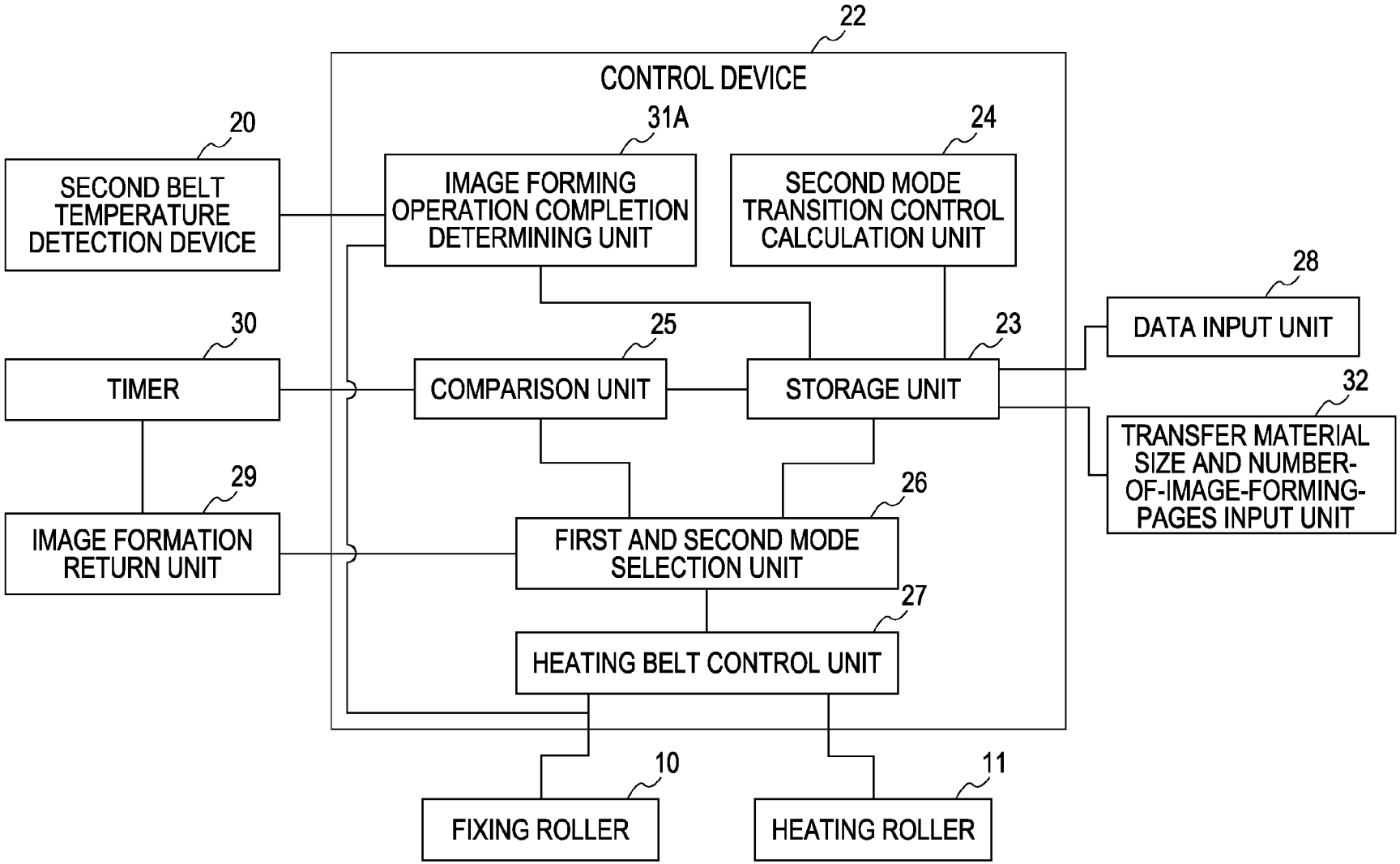
FIG. 13 is a block diagram showing another example of the fourth embodiment of the control device of the fixing device of the example shown in FIG. 2.
Figure 14:
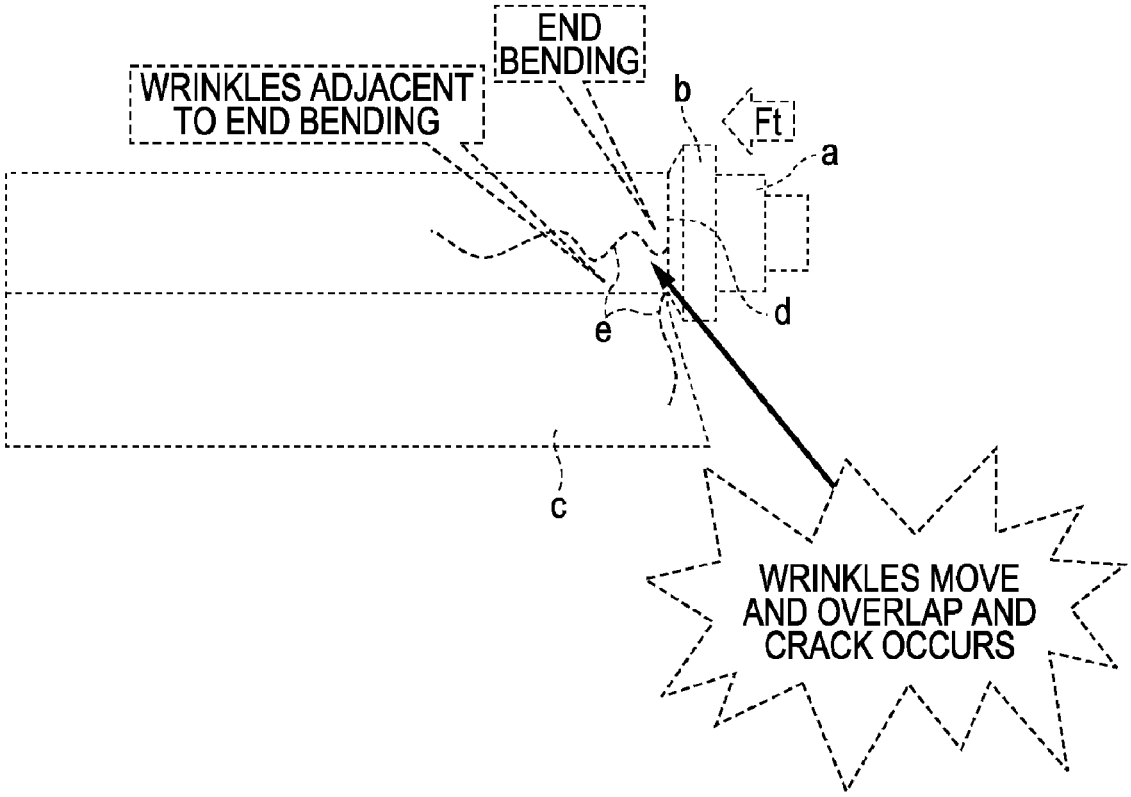
FIG. 14 is a view explaining a problem of a heating belt of the related art.

The control of the heating belt 8 using the mode transition reference heating time $t_{bs}$ (sec) is performed by the control device 22 shown in FIG. 13. In this case, the control device 22 is provided with a timer 30. The timer 30 is supplied with an operation signal from the image formation return unit 29 during the above-described returning. Then, the timer 30 starts measuring a period of time in response to the input of the operation signal and outputs the measured period of time to the comparison unit 25. Moreover, similar to the above-described example, the operation signal of the image formation return unit 29 is input to the first and second mode selection unit 26 as the switching signal. Therefore, similar to the above-described example, the control of the heating belt 8 by the first mode is started.

The storage unit 23 of the control device 22 has stored therein the calorific capacity $C_{hr}$ (KJ/K) of the heating belt 8 and the heating roller 11 and the heater wattage W (J/sec) of the heater 13. The second mode transition control calculation unit 24 calculates the mode transition reference temperature $T_{bs}$ (° C.) on the basis of Equation 14 and calculates the time of the right side of Equation 16. Further, the calculated time of the right side of Equation 16 or a period of time slightly longer than the calculated time is set as the mode transition reference heating time $t_{bs}$ (sec) and stored in the storage unit 23. When the time measured by the timer 30 from the start of the control of the heating belt 8 by the first mode reaches the mode transition reference heating time $t_{bs}$ (sec), the comparison unit 25 outputs the switching signal to the first and second mode selection unit 26. Thereafter, similar to the above-described example, the heating belt 8 is controlled by the second mode.

Further, in the control of the heating belt 8 using the mode transition reference heating time $t_{bs}$ (sec), the belt destroy temperature $T_0$ (° C.) of the above-described example is used. Other configurations and other operations of the fixing device 6, the control device 22 and the image forming apparatus 1 of this example are the same as those of the above-described example.

When an environment temperature (for example, a room temperature of 20° C. or the like) of a place where the image forming apparatus 1 is used is used as the temperature $T_r$ of the heating belt in Equations 13 and 14, the image forming operation completion determining unit 31A shown in FIGS. 12 and 13 is not required. In such a case, the environment temperature (for example, a room temperature of 20° C. or the like) may be input, for example, by the data input unit 28 to be stored in the storage unit 23.

In the invention, a cylindrical drum may be used as the intermediate transfer medium, instead of the endless intermediate transfer belt 3. The invention is applicable to any image forming apparatus 1 including an image forming apparatus without an intermediate transfer medium, if the fixing device 6 has the heating belt 8. The invention may be variously modified in the range described in claims.

What is claimed is:

1. A fixing device comprising: at least a heating roller, a fixing roller, a heating belt which is stretched over the heating roller and the fixing roller, is heated by the heating roller, and is rotated by a driving unit so as to fix a toner image of a transfer material, and a bias preventing unit of the heating belt provided in the heating roller, wherein:

a first mode which is a combination mode of the heating of the heating belt and the rotation stop of the heating belt and a second mode which is a combination mode of the heating of the heating belt and the rotation of the heating belt are set;

at the time of returning of the heating belt for an image forming operation from non-heating and non-rotation of the heating belt, the heating belt is controlled by the first mode and the heating belt is then controlled by the second mode transitioned from the first mode; and when a temperature of the heating belt becomes equal to or larger than a mode transition reference temperature which is set on the basis of a predetermined condition, the transition from the first mode to the second mode is performed.

2. The fixing device according to claim 1, wherein when the temperature of the heating belt becomes equal to or larger than the mode transition reference temperature which is set in advance, the transition from the first mode to the second mode is performed.

3. The fixing device according to claim 2, wherein the mode transition reference temperature is defined by:

$$\frac{(\alpha_{hr} - \alpha_b)T_b + \alpha_{hr}T_r}{2\alpha_{hr} - \alpha_b} \leqq T_{bs} \qquad \text{Equation 1}$$

where, $T_b$: Belt control temperature (° C.) of the heating belt during image formation, $T_r$: Environment temperature (° C.) (for example, a room temperature or the like, and, as a detailed value, for example 20° C.), $T_{bs}$: Mode transition reference temperature (° C.) of the heating belt during the transition from the first mode to the second mode, $\alpha_{hr}$: Linear expansion coefficient (1/° C.) of the heating roller, and $\alpha_b$: Linear expansion coefficient (1/° C.) of the heating belt.

4. The fixing device according to claim 3, wherein the mode transition reference temperature is further defined by:

$$T_{bs} < T_0 \qquad \text{Equation 2}$$

where, $T_0$: Destroy temperature (° C.) of the heating belt.

5. The fixing device according to claim 2, wherein the temperature of the heating belt is a temperature at a position thereof at which the temperature of the heating belt on a side thereof where the heating belt is stretched to the heating roller becomes the lowest.

6. The fixing device according to claim 1, wherein the mode transition reference temperature is set on the basis of the temperature of the heating belt at the time of the start of the control of the heating belt by the first mode, and wherein when the temperature of the heating belt becomes equal to or larger than the mode transition reference temperature, the transition from the first mode to the second mode is performed.

7. The fixing device according to claim 6, wherein the mode transition reference temperature is defined by:

$$\frac{(\alpha_{hr}-\alpha_b)T_b+\alpha_{hr}T_r}{2\alpha_{hr}-\alpha_b} \leqq T_{bs} \quad \text{Equation 3}$$

where, $T_b$: Belt control temperature (° C.) of the heating belt during image formation, $T_r$: Temperature (° C.) of the heating belt at the time of the start of the first mode, $T_{bs}$: Mode transition reference temperature (° C.) of the heating belt during the transition from the first mode to the second mode, $\alpha_{hr}$: Linear expansion coefficient (1/° C.) of the heating roller, and $\alpha_b$: Linear expansion coefficient (1/° C.) of the heating belt.

8. The fixing device according to claim 7, wherein the mode transition reference temperature is further defined by:

$$T_{bs}<T_0 \quad \text{Equation 4}$$

where, $T_0$: Destroy temperature (° C.) of the heating belt.

9. The fixing device according to claim 6, wherein the temperature of the heating belt is a temperature at a position thereof at which the temperature of the heating belt on a side thereof where the heating belt is stretched to the heating roller becomes the lowest.

10. The fixing device according to claim 1, wherein the mode transition reference temperature is set on the basis of the temperature of the heating belt during the rotation stop of the heating belt at the end of a previous image forming operation, and wherein when the temperature of the heating belt in the first mode becomes equal to or larger than the mode transition reference temperature, the transition from the first mode to the second mode is performed.

11. The fixing device according to claim 10, wherein the mode transition reference temperature is defined by:

$$\frac{(\alpha_{hr}-\alpha_b)T_b+\alpha_{hr}T_r}{2\alpha_{hr}-\alpha_b} \leqq T_{bs} \quad \text{Equation 5}$$

where, $T_b$: Temperature (° C.) of the heating belt during the rotation stop of the heating belt at the end of the previous image forming operation, $T_{bs}$: Mode transition reference temperature (° C.) of the heating belt during the transition from the first mode to the second mode, $\alpha_{hr}$: Linear expansion coefficient (1/° C.) of the heating roller, and $\alpha_b$: Linear expansion coefficient (1/° C.) of the heating belt, and wherein the temperature $T_r$ (° C.) is a room temperature or the temperature of the heating belt at the time of the start of the first mode.

12. The fixing device according to claim 11, wherein the mode transition reference temperature is further defined by:

$$T_{bs}<T_0 \quad \text{Equation 6}$$

where, $T_0$: Destroy temperature (° C.) of the heating belt.

13. The fixing device according to claim 10, wherein the temperature of the heating belt is the highest among the temperatures of the heating belt in a width direction thereof.

14. The fixing device according to claim 1, wherein the mode transition reference temperature is set on the basis of at least one of a size of the transfer material with respect to a width of the heating belt during a previous image forming operation, the size being taken in the same direction as a width direction of the heating belt, and the number of image forming pages during the previous image forming operation, and wherein when the temperature of the heating belt in the first mode becomes equal to or larger than the mode transition reference temperature, the transition from the first mode to the second mode is performed.

15. The fixing device according to claim 14, wherein when the mode transition reference temperature is set on the basis of only the size of the transfer material, the mode transition reference temperature when the size of the transfer material is small is set to be higher than that when the size of the transfer material is large, wherein when the mode transition reference temperature is set on the basis of only the number of image forming pages, the mode transition reference temperature when the number of consecutive pages of the number of image forming pages is large is set to be higher than that when the number of consecutive pages is small, and wherein when the mode transition reference temperature is set on the basis of both the size of the transfer material and the number of image forming pages, the mode transition reference temperature when the size of the transfer material is small is set to be higher than that when the size of the transfer material is large, while the mode transition reference temperature when the number of consecutive pages of the number of image forming pages is large is set to be higher than that when the number of consecutive pages is small.

16. The fixing device according to claim 15, wherein the mode transition reference temperature is defined by:

$$\frac{(\alpha_{hr}-\alpha_b)T_{bJOB}+\alpha_{hr}T_r}{2\alpha_{hr}-\alpha_b} \leqq T_{bs} \quad \text{Equation 7}$$

where, $T_{bJOB}$: Predicted temperature (° C.) of the heating belt which is set by adding a predetermined temperature to the temperature of the heating belt during the rotation stop of the heating belt at the end of the previous image forming operation on the basis of the transfer material size and the number of image forming pages during the previous image forming operation, $T_{bs}$: Mode transition reference temperature (° C.) of the heating belt during the transition from the first mode to the second mode, $\alpha_{hr}$: Linear expansion coefficient (1/° C.) of the heating roller, and $\alpha_b$: Linear expansion coefficient (1/° C.) of the heating belt, wherein the temperature $T_b$ (° C.) is set to be higher than the temperature of the heating belt during the rotation stop of the heating belt at the end of the previous image forming operation at least when the size of the transfer material is small or when the number of consecutive pages of the number of image forming pages is large, and wherein the temperature $T_r$ (° C.) is a room temperature or the temperature of the heating belt at the time of the start of the first mode.

17. The fixing device according to claim 16, wherein the mode transition reference temperature is further defined by:

$$T_{bs}<T_0 \quad \text{Equation 8}$$

where, $T_0$: Destroy temperature (° C.) of the heating belt.

18. The fixing device according to claim 14, wherein the temperature of the heating belt is the highest among the temperatures of the heating belt in a width direction thereof.

19. An image forming apparatus comprising: at least a latent image carrier which carries an electrostatic latent image, a development device which develops the electrostatic latent image of the latent image carrier and forms a toner image, a transfer device which transfers the toner image of the latent image carrier to a transfer material, and a fixing device which fixes the toner image of the transfer material, wherein:

the fixing device is the fixing device according to claim 1;

at least a belt temperature detection device which detects the temperature of the heating belt and a control device which controls the heating of the heating belt by the heating roller and the rotation of the heating belt by the driving unit are included;

the control device includes at least a first and second mode selection unit which selects the first mode and the second mode, and a heating belt control unit which controls the heating and the rotation of the heating belt by the mode selected by the first and second mode selection unit, among the first and second modes; and the first and second mode selection unit controls the heating and the rotation of the heating belt by the first mode at the time of the returning of the heating belt and controls the heating and the rotation of the heating belt by the second mode by allowing the transition from the first mode to the second mode when the temperature of the heating belt of the belt temperature detection device reaches the mode transition reference temperature.

20. A fixing device comprising: at least a heating roller, a fixing roller, a heating belt which is stretched over the heating roller and the fixing roller, is heated by the heating roller, and is rotated by a driving unit so as to fix a toner image of a transfer material, and a bias preventing unit of the heating belt provided in the heating roller, wherein:

a first mode which is a combination mode of the heating of the heating belt and the rotation stop of the heating belt and a second mode which is a combination mode of the heating of the heating belt and the rotation of the heating belt are set;

at the time of returning of the heating belt for an image forming operation from non-heating and non-rotation of the heating belt, the heating belt is controlled by the first mode and the heating belt is then controlled by the second mode transitioned from the first mode; and when a heating time of the heating belt becomes equal to or larger than a mode transition reference heating time which is set on the basis of a predetermined condition, the transition from the first mode to the second mode is performed.

21. The fixing device according to claim 20, wherein when the heating time of the heating belt becomes equal to or larger than the mode transition reference heating time which is set in advance, the transition from the first mode to the second mode is performed.

22. The fixing device according to claim 21, wherein the mode transition reference heating time is defined by:

$$\frac{(\alpha_{hr}-\alpha_b)T_b+\alpha_{hr}T_r}{2\alpha_{hr}-\alpha_b} \leqq T_{bs} \quad \text{Equation 9}$$

where, $T_b$: Belt control temperature (° C.) of the heating belt during image formation, $T_r$: Environment temperature (° C.) (for example, a room temperature or the like, and, as a detailed value, for example 20° C.), $T_{bs}$: Mode transition reference temperature (° C.) of the heating belt during the transition from the first mode to the second mode, $\alpha_{hr}$: Linear expansion coefficient (1/° C.) of the heating roller, and $\alpha_b$: Linear expansion coefficient (1/° C.) of the heating belt; and $$t_{bs} \geqq C_{hr} \times T_{bs} \times (T_{bs}-T_r) \times 2/W \quad \text{Equation 10}$$

where, $t_{bs}$: Mode transition reference heating time (sec) which is a heating time required for starting the heating belt, $C_{hr}$: Calorific capacity (KJ/K) of the heating roller and the heating belt, W: Heater wattage (J/sec), and Other symbols are the same as those of Equation 9.

23. The fixing device according to claim 20, wherein the mode transition reference heating time is set on the basis of the temperature of the heating belt at the time of the start of the control of the heating belt by the first mode, and wherein when a period of time lapsed from the start of the control of the heating belt by the first mode becomes equal to or larger than the mode transition reference heating time, the transition from the first mode to the second mode is performed.

24. The fixing device according to claim 23, wherein the mode transition reference heating time is defined by:

$$\frac{(\alpha_{hr}-\alpha_b)T_b+\alpha_{hr}T_r}{2\alpha_{hr}-\alpha_b} \leqq T_{bs} \quad \text{Equation 11}$$

where, $T_b$: Belt control temperature (° C.) of the heating belt during image formation, $T_r$: Environment temperature (° C.) (for example, a room temperature or the like, and, as a detailed value, for example 20° C.), $T_{bs}$: Mode transition reference temperature (° C.) of the heating belt during the transition from the first mode to the second mode, $\alpha_{hr}$: Linear expansion coefficient (1/° C.) of the heating roller, and $\alpha_b$: Linear expansion coefficient (1/° C.) of the heating belt; and $$t_{bs} \geqq C_{hr} \times T_{bs} \times (T_{bs} - T_r) \times 2/W \quad \text{Equation 12}$$

where, $t_{bs}$: Mode transition reference heating time (sec) which is a heating time required for starting the heating belt, $C_{hr}$: Calorific capacity (KJ/K) of the heating roller and the heating belt, W: Heater wattage (J/sec), and Other symbols are the same as those of Equation 11.

25. The fixing device according to claim 20, wherein the mode transition reference heating time is set on the basis of the temperature of the heating belt during the rotation stop of the heating belt at the end of a previous image forming operation, and wherein when a period of time lapsed from the start of the control of the heating belt by the first mode becomes equal to or larger than the mode transition reference heating time, the transition from the first mode to the second mode is performed.

26. The fixing device according to claim 25, wherein the mode transition reference heating time is defined by:

$$\frac{(\alpha_{hr} - \alpha_b)T_b + \alpha_{hr}T_r}{2\alpha_{hr} - \alpha_b} \leqq T_{bs} \quad \text{Equation 13}$$

where, $T_b$: Temperature (° C.) of the heating belt during the rotation stop of the heating belt at the end of the previous image forming operation, $T_{bs}$: Mode transition reference temperature (° C.) of the heating belt during the transition from the first mode to the second mode, $\alpha_{hr}$: Linear expansion coefficient (1/° C.) of the heating roller, and $\alpha_b$: Linear expansion coefficient (1/° C.) of the heating belt; and $$t_{bs} \geqq C_{hr} \times T_{bs} \times (T_{bs} - T_r) \times 2/W \quad \text{Equation 14}$$

where, $t_{bs}$: Mode transition reference heating time (sec) which is a heating time required for starting the heating belt, $C_{hr}$: Calorific capacity (KJ/K) of the heating roller and the heating belt, W: Heater wattage (J/sec), and Other symbols are the same as those of Equation 13, and wherein the temperature $T_r$ (° C.) is a room temperature or the temperature of the heating belt at the time of the start of the first mode.

27. The fixing device according to claim 26, wherein the mode transition reference temperature is further defined by:

$$T_{bs} < T_0 \quad \text{Equation 15}$$

where, $T_0$: Destroy temperature (° C.) of the heating belt.

28. The fixing device according to claim 25, wherein the temperature of the heating belt is the highest among the temperatures of the heating belt in a width direction thereof.

29. The fixing device according to claim 20, wherein the mode transition reference heating time is set on the basis of at least one of a size of the transfer material with respect to a width of the heating belt during a previous image forming operation, the size being taken in the same direction as a width direction of the heating belt, and the number of image forming pages during the previous image forming operation, and wherein when a period of time lapsed from the start of the control of the heating belt by the first mode becomes equal to or larger than the mode transition reference heating time, the transition from the first mode to the second mode is performed.

30. The fixing device according to claim 29, wherein when the mode transition reference heating time is set on the basis of only the size of the transfer material, the mode transition reference heating time when the size of the transfer material is small is set to be higher than that when the size of the transfer material is large, wherein when the mode transition reference heating time is set on the basis of only the number of image forming pages, the mode transition reference heating time when the number of consecutive pages of the number of image forming pages is large is set to be higher than that when the number of consecutive pages is small, and wherein when the mode transition reference heating time is set on the basis of both the size of the transfer material and the number of image forming pages, the mode transition reference heating time when the size of the transfer material is small is set to be higher than that when the size of the transfer material is large, while the mode transition reference heating time when the number of consecutive pages of the number of image forming pages is large is set to be higher than that when the number of consecutive pages is small.

31. The fixing device according to claim 30, wherein the mode transition reference heating time is defined by:

$$\frac{(\alpha_{hr} - \alpha_b)T_{bJOB} + \alpha_{hr}T_r}{2\alpha_{hr} - \alpha_b} \leqq T_{bs} \quad \text{Equation 16}$$

where, $T_{bJOB}$: Predicted temperature (° C.) of the heating belt which is set by adding a predetermined temperature to the temperature of the heating belt during the rotation stop of the heating belt at the end of the previous image forming operation on the basis of the transfer material size and the number of image forming pages during the previous image forming operation, $T_{bs}$: Mode transition reference temperature (° C.) of the heating belt during the transition from the first mode to the second mode, $\alpha_{hr}$: Linear expansion coefficient (1/° C.) of the heating roller, and $\alpha_b$: Linear expansion coefficient (1/° C.) of the heating belt; and $$t_{bs} \geqq C_{hr} \times T_{bs} \times (T_{bs} - T_r) \times 2/W \quad \text{Equation 17}$$

where, $t_{bs}$: Mode transition reference heating time (sec) which is a heating time required for starting the heating belt, $C_{hr}$: Calorific capacity (KJ/K) of the heating roller and the heating belt, W: Heater wattage (J/sec), and Other symbols are the same as those of Equation 16, wherein the temperature $T_b$ (° C.) is set to be higher than the temperature of the heating belt during the rotation stop of the heating belt at the end of the previous image forming operation at least when the size of the transfer material is small or when the number of consecutive pages of the number of image forming pages is large, and wherein the temperature $T_r$ (° C.) is a room temperature or the temperature of the heating belt at the time of the start of the first mode.

32. The fixing device according to claim 31, wherein the mode transition reference temperature is further defined by:

$$T_{bs}<T_0 \quad \text{Equation 18}$$

where, $T_0$: Destroy temperature (° C.) of the heating belt.

33. The fixing device according to claim 29, wherein the temperature of the heating belt is the highest among the temperatures of the heating belt in a width direction thereof.

34. An image forming apparatus comprising: at least a latent image carrier which carries an electrostatic latent image, a development device which develops the electrostatic latent image of the latent image carrier and forms a toner image, a transfer device which transfers the toner image of the latent image carrier to a transfer material, and a fixing device which fixes the toner image of the transfer material, wherein:

the fixing device is the fixing device according to claim 20;

at least a timer which measures time and a control device which controls the heating of the heating belt by the heating roller and the rotation of the heating belt by the driving unit are included;

the timer is a timer which measures a period of time lapsed from the returning of the heating belt;

the control device includes at least a first and second mode selection unit which selects the first mode and the second mode, and a heating belt control unit which controls the heating and the rotation of the heating belt by the mode selected by the first and second mode selection unit, among the first and second modes; and the first and second mode selection unit controls the heating and the rotation of the heating belt by the first mode at the time of the returning of the heating belt and controls the heating and the rotation of the heating belt by the second mode by allowing the transition from the first mode to the second mode when the period of time measured by the timer reaches the mode transition reference heating time.

* * * * *